United States Patent [19]

Umemoto et al.

[11] Patent Number: 4,622,287

[45] Date of Patent: Nov. 11, 1986

[54] SILVER HALIDE COLOR PHOTOGRAPHIC LIGHT-SENSITIVE MATERIAL

[75] Inventors: Makoto Umemoto; Kozo Aoki, both of Kanagawa, Japan

[73] Assignee: Fuji Photo Film Co., Ltd., Kanagawa, Japan

[21] Appl. No.: 727,719

[22] Filed: Apr. 26, 1985

[30] Foreign Application Priority Data

Apr. 26, 1984 [JP] Japan ..... 59-84962

[51] Int. Cl.[4] ..... G03C 1/46; G03C 1/84; G03C 7/32

[52] U.S. Cl. ..... 430/505; 430/507; 430/512; 430/558

[58] Field of Search ..... 430/505, 558, 507, 512

[56] References Cited

U.S. PATENT DOCUMENTS

| | | | |
|---|---|---|---|
| 3,725,067 | 3/1973 | Bailey et al. | 430/558 |
| 4,456,681 | 6/1984 | Kadowaki et al. | 430/505 |
| 4,500,630 | 2/1985 | Sato et al. | 430/551 X |
| 4,510,234 | 4/1985 | Matsuzaka et al. | 430/558 X |
| 4,513,079 | 4/1985 | Sakanoue et al. | 430/505 X |
| 4,522,915 | 6/1985 | Ichijima et al. | 430/505 |
| 4,524,132 | 6/1985 | Aoki et al. | 430/558 |
| 4,536,472 | 8/1985 | Kato et al. | 430/505 |
| 4,537,857 | 8/1985 | Takada et al. | 430/558 X |

FOREIGN PATENT DOCUMENTS

| | | | |
|---|---|---|---|
| 0115304 | 8/1984 | European Pat. Off. | 430/505 |

*Primary Examiner*—John E. Kittle
*Assistant Examiner*—Mukund J. Shah
*Attorney, Agent, or Firm*—Sughrue, Mion, Zinn, Macpeak, and Seas

[57] ABSTRACT

A silver halide color photographic light-sensitive material comprising a support and red-sensitive, green-sensitive and blue-sensitive light-sensitive layers formed on the support. The light-sensitive layers separately contain a coupler of formula (I), a coupler of formula (II) or (III), and a coupler of formula (IV).

(I)

(II)

(III)

(IV)

This novel combination of couplers leads to good color formability, improved color reproducibility, improved image preservability and good color balance.

20 Claims, No Drawings

SILVER HALIDE COLOR PHOTOGRAPHIC LIGHT-SENSITIVE MATERIAL

FIELD OF THE INVENTION

This invention relates to a multilayer silver halide color photographic light-sensitive material. More specifically, it relates to a multilayer silver halide color photographic light-sensitive material which contains a novel combination of couplers and has good color formability, improved color reproducibility, improved image preservability and a good color balance.

BACKGROUND OF THE INVENTION

In a silver halide color photographic light-sensitive material, a multilayer light-sensitive layer composed of three kinds of silver halide emulsion layers selectively sensitized to blue light, green light and red light is coated on a support. For example, in a so-called color photographic paper, a red-sensitive emulsion layer, a green-sensitive emulsion layer and a blue-sensitive emulsion layer are usually coated on the support in this order from the exposure side, and a color mixing preventing or ultraviolet light absorbing interlayer, a protective layer, etc., are provided among the light-photosensitive layers.

In a color positive film, a green-sensitive emulsion layer, a red-sensitive emulsion layer and a blue-sensitive emulsion layer are coated in this order on a support generally from a side far from the support, i.e., from the exposure side. A color negative film has a variety of layer arrangements, but generally, a blue-sensitive emulsion layer, a green-sensitive emulsion layer and a red-sensitive emulsion layer are coated in this order from the exposure side. Some photographic materials having at least two emulsion layers having the same color sensitivity but different sensitivities include an emulsion layer of a different color sensitivity arranged between the first-mentioned emulsion layers with further inclusion of a bleachable yellow filter layer, an interlayer, a protective layer, etc.

To form a color photographic image, photographic couplers of three colors, yellow, magenta and cyan are included in light-sensitive layers of a photographic material, and the exposed photographic material is subjected to color development with so-called color developing agents. A coupling reaction of the oxidation product of an aromatic primary amine with the couplers gives colored dyes. The couplers desirably have the highest possible coupling speeds at this time to give high color densities within a limited time period of development. The colored dyes are required to be brilliant cyan, magenta and yellow dyes of little subsidiary absorptions and to give a color photographic image of good color reproducibility.

The color photographic image formed, on the other hand, is required to have good preservability under various conditions. To meet this requirement, it is important that the speeds of fading or discoloration of the colored dyes of different hues should be slow, and that the speed of fading should be as uniform as possible over the entire range of image densities to avoid changes in the color balance of the remaining dye image.

With conventional photographic materials, particularly conventional color papers, cyan dye images are greatly degraded by fading in the dark under the influences of humidity and heat upon long term storage, and their color balance tends to be varied. Hence, a strong desire exists to improve the cyan dye images in this respect. The conventional photographic materials have a strong contradictory tendency. For example, a cyan dye image resistant to fading in the dark has a poor hue and is susceptible to fading or vanishing under light. Accordingly, a novel combination of couplers has been desired.

In an attempt to solve the foregoing problem partly, certain combinations of couplers have heretofore been proposed, and examples thereof are described, for example, in Japanese Patent Publication No. 7344/77, and Japanese Patent Application (OPI) Nos. 200037/82, 57238/84 and 160143/84 (the term "OPI" as used herein refers to a "published unexamined Japanese patent application open to public inspection"). These combinations, however, have not been able to entirely remove various defects such as insufficient color formability, poor hues of formed dyes, adverse effects on color reproduction, variations in the color balance of residual dye images owing to degradation by light or heat, or temporary disappearance of cyan under light. The phenomenon of temporary disappearance of cyan is reversibly corrected in the dark to regain the original color, but an improvement is also desired in this regard.

SUMMARY OF THE INVENTION

The present invention provides a simultaneous solution of the above problems.

Specifically, it is a primary object of this invention to provide a multilayer silver halide color photographic light-sensitive material containing a novel combination of cyan, magenta and yellow couplers which leads to good color formability, improved color reproducibility of the resulting color photographic image, improved image preservability and particularly the freedom from variations in color balance both in the dark and under light exposure over an extended period of time.

Another object of this invention is to provide a multilayer silver halide color photographic light-sensitive material with which a temporary reduction in the density of a cyan image under strong light irradiation such as direct sunlight (to be referred to as color disappearance) can be circumvented.

The above objects of this invention are achieved by a silver halide color photographic light-sensitive material comprising a support and red-sensitive, green-sensitive and blue-sensitive light-sensitive layers formed on the support, said light-sensitive layers separately containing a coupler represented by the following formula (I), a coupler represented by the following formula (II) or (III), and a coupler represented by the following formula (IV).

(I)

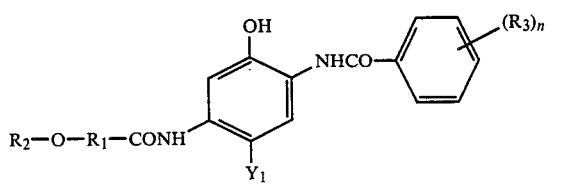

-continued

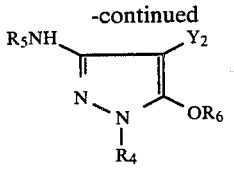

(II)

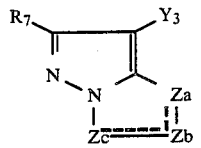

(III)

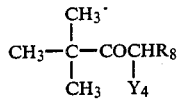

(IV)

In general formulae (I), (II), (III) and (IV):

$R_1$ represents a substituted or unsubstituted divalent aliphatic group, $R_2$ represents a phenyl group substituted by at least one cyano group, or a phenyl group substituted by at least one chlorine aton at the ortho-position, $R_3$ represents a hydrogen atom, a halogen atom, or a substituted or unsubstituted alkyl or alkoxy group, n represents an integer of 1 to 5, and when n is 2 or more, the $R_3$ substituents are identical or different, $R_4$ and $R_5$ each represents a substituted or unsubstituted phenyl group, $R_6$ represents a hydrogen atom, an acyl group or an aliphatic or aromatic sulfonyl group, $R_7$ represents a hydrogen atom or a substituent, $R_8$ represents a substituted or unsubstituted N-phenylcarbamoyl group, $Z_a$, $Z_b$ and $Z_c$ each represents methine, substituted methine, =N— or —NH—, $Y_1$, $Y_2$, $Y_3$ and $Y_4$ each represents a hydrogen atom or a group which can be split off during the coupling reaction with the oxidation product of a developing agent, a dimer or a polymer may be formed by $R_2$, $R_3$ or $Y_1$; $R_4$, $R_5$ or $Y_2$; $R_7$, $Y_3$ or $Z_a$, $Z_b$ or $Z_c$ which is substituted methine; or $R_8$ or $Y_4$, and the aliphatic group above is linear, branched or cyclic, and saturated or unsaturated.

DETAILED DESCRIPTION OF THE INVENTION

In formula (I), the divalent aliphatic group for $R_1$ may be linear or cyclic and saturated or unsaturated, and preferably has 1 to 32 carbon atoms. Typical examples are methylene, 1,3-propylene, 1,4-butylene and 1,4-cyclohexylene groups. The divalent aliphatic group may be branched by being substituted by another aliphatic group, or contain at least one substituent group (including substituent atom; this is the same for the following description) exemplified below. Examples of substituents for $R_1$ in this invention include aromatic groups (such as phenyl and naphthyl groups), heterocyclic groups (such as 2-pyridyl, 2-imidazolyl, 2-furyl and 6-quinolyl groups), aliphatic oxy groups (such as methoxy, 2-methoxyethoxy and 2-propenyloxy groups), aromatic oxy groups (such as 2,4-di-tert-amylphenoxy, 4-cyanophenoxy and 2-chlorophenoxy groups), acyl groups (such as acetyl and benzoyl groups), ester groups (such as butoxycarbonyl, phenoxycarbonyl, acetoxy, benzoyloxy, butoxysulfonyl and toluenesulfonyloxy groups), amido groups (such as acetylamino, methanesulfonamido, ethylcarbamoyl and butylsulfamoyl groups), imido groups (such as succinimido and hydantoinyl groups), ureido groups (such as phenylureido and dimethylureido groups), aliphatic or aromatic sulfonyl groups (such as methanesulfonyl and phenylsulfonyl groups), aliphatic or aromatic thio groups (such as phenylthio and ethylthio groups), a hydroxyl group, a cyano group, a carboxyl group, a nitro group, a sulfone group, and a halogen atom (such as fluorine, chlorine and bromine atoms). Where there are two or more substituents, they may be identical or different.

$R_2$ represents a phenyl group which is substituted at least by a cyano group, or which is substituted by a chlorine atom at the ortho-position. The phenyl group may also be substituted by the substituents described above for the substitution of $R_1$. The alkyl or alkoxy group for $R_3$ may be linear, branched or cyclic, and preferably has 1 to 22 carbon atoms. Examples of the halogen atom for $R_3$ are a fluorine atom, a chlorine atom, a bromine atom, and an iodine atom. It may be substituted by the substituents described for $R_1$. Examples of the alkyl group are methyl, ethyl, n-butyl, tert-butyl, hexadecyl and cyclohexyl groups, and examples of the alkoxy group are the above exemplified alkyl groups to which an oxygen atom is attached.

$R_1$ and aliphatic groups to be described below include unsaturated aliphatic groups, for example, alkenyl groups (such as propenyl and 2-octadecenyl groups) and alkynyl groups (such as a propargyl group).

When $Y_1$, $Y_2$, $Y_3$ or $Y_4$ in formula (I), (II), (III) or (IV) represents a group to be split off upon coupling (to be referred to as a "split-off group"), it is a group which bonds an aliphatic group, an aromatic group, a heterocyclic group, an aliphatic, aromatic or heterocyclic sulfonyl group, or an aliphatic, aromatic or heterocyclic carbonyl group to the coupling active carbon through an oxygen, nitrogen, sulfur or carbon atom; a halogen atom; an aromatic azo group; etc. The aliphatic, aromatic or heterocyclic groups included in these split-off groups may be substituted by the substituents described above for $R_1$. When there are two or more such substituents, they may be the same or different. These substituents may further have the substituents described for $R_1$.

Specific examples of the split-off groups include halogen atoms (such as fluorine, chlorine and bromine atoms), alkoxy groups (such as ethoxy, dodecyloxy, methoxyethylcarbamoylmethoxy, carboxypropyloxy and methylsulfonylethoxy groups), aryloxy groups (such as 4-chlorophenoxy, 4-methoxyphenoxy and 4-carboxyphenoxy groups), acyloxy groups (such as acetoxy, tetradecanoyloxy) and benzoyloxy groups), aliphatic or aromatic sulfonyloxy groups (such as methanesulfonyloxy and toluenesulfonyloxy groups), acylamino groups (such as dichloroacetylamino and heptafluorobutyrylamino groups), aliphatic or aromatic sulfonamido groups (such as methanesulfonamino and p-toluenesulfonylamino groups), alkoxycarbonyloxy groups (such as ethoxycarbonyloxy and benzyloxycarbonyloxy groups), aryloxycarbonyloxy groups (such as a phenoxycarbonyloxy group), aliphatic, aromatic or heterocyclic thio groups (such as ethylthio, phenylthio and tetrazoylthio groups), carbamoylamino groups (such as N-methylcarbamoylamino and N-phenylcarbamoylamino groups), 5- or 6-membered nitrogen-containing heterocyclic groups (such as imidazolyl, pyrazolyl, triazolyl, tetrazolyl and 1,2-dihydro-2-oxo-1-pyridyl groups), imido groups (such as succinimido and hydantoinyl groups), and aromatic azo groups (such as a phenylazo group). These groups may be substituted by the substituents described for $R_1$. As an example of a split-off group bonded through a carbon atom, there is a bis-type coupler obtained by condensing a 4-equivalent coupler with an aldehyde or ketone. The split-off groups in accordance with this invention may include photographically useful groups such as a development inhibitor or a development accelerator. Preferred combinations of the split-off groups in each of the above formulae will be described later in this specification.

Advantageously, in formula (I), $R_1$ is a linear or branched alkylene group preferably having 1 to 22 carbon atoms, more preferably 5 to 16 carbon atoms. In formula (I), the substituent of the phenyl group for $R_2$ is preferably a chlorine atom or an alkyl group, more preferably a branched alkyl group with 3 to 12 carbon atoms. The split-off group $Y_1$ is preferably a hydrogen atom or a halogen atom, especially preferably a chlorine atom.

In formula (I), it is preferred that at least one $R_3$ other than hydrogen is substituted at a position ortho to —NHCO—.

A most preferred coupler represented by formula (I) according to this invention comprises the coupler, wherein $R_1$ is a branched alkylene group, $R_2$ is a phenyl group substituted by at least one chlorine atom at the ortho-position, and $R_3$ is a halogen atom or an alkyl group.

It is known in the art that the magenta coupler represented by formula (II) has the following keto-enol type tautomerism when $R_6$ is a hydrogen atom.

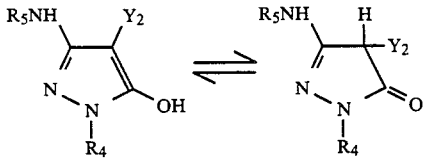

In formula (II), substituents for $R_4$ and $R_5$ are the same as the substituents described for $R_1$. Where there are two or more substituents, they may be the same or different.

In formula (II), $R_6$ is preferably a hydrogen atom, an aliphatic acyl group or an aliphatic sulfonyl group, especially preferably a hydrogen atom. Examples of the aliphatic moiety of the aliphatic acyl group or aliphatic sulfonyl group for $R_6$ are those as described for $R_1$. $Y_2$ is preferably a coupling split-off group which is connected through a sulfur, oxygen or nitrogen atom to the coupling position. The split-off group which is connected through a sulfur atom is especially preferred.

The compound represented by formula (III) is a 5-member-5-member fused nitrogen-containing heterocyclic coupler (to be referred to as a 5,5N-heterocyclic coupler), and its color forming matrix has aromaticity isoelectronic with naphthalene and is of a chemical structure usually called azapentalene generically. Of the couplers of formula (III), preferred are 1H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles and 1H-pyrazolo[1,5-d]tetrazoles, which are represented respectively by the following formulae (V), (VI), (VII), (VIII) and (IX).

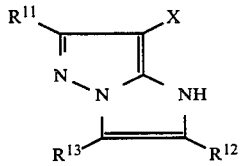

(V)

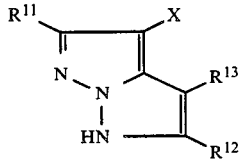

(VI)

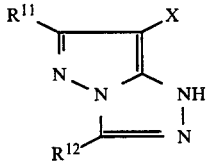

(VII)

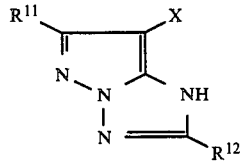

(VIII)

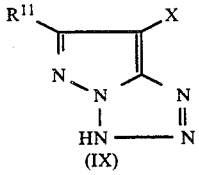

(IX)

The substituents in formulae (V) to (IX) will be described in detail.

$R^{11}$, $R^{12}$ and $R^{13}$ each represents an aliphatic, aromatic or heterocyclic group which may be substituted by at least one of the substituents described for $R_1$ (the above group of the substituents will be referred to as R). $R^{11}$, $R^{12}$ and $R^{13}$ may also be RO—, $$RO-,\ R\underset{\underset{O}{\|}}{C}-,\ R\underset{\underset{O}{\|}}{C}O-,\ RSO-,\ RSO_2-,\ RSO_2NH-,$$

$$R\underset{\underset{O}{\|}}{C}NH-,\ RNH-,\ RS-,\ RO\underset{\underset{O}{\|}}{C}NH-,$$

a hydrogen atom, a halogen atom, a cyano group, or an imido group. $R^{11}$, $R^{12}$ and $R^{13}$ may further be a carbamoyl, sulfamoyl, ureido or sulfamoylamino group, and the nitrogen atoms of these groups may be substituted by the substituents described for $R_1$. X is the same as $Y_3$. Either one of $R^{11}$, $R^{12}$, $R^{13}$ and X may be a divalent group and form a dimer, or may be a divalent group linking the main chain of the polymer with the chromophore of the coupler.

Preferably, $R^{11}$, $R^{12}$ and $R^{13}$ each represents a hydrogen atom, a halogen atom, a substituent defined by R, RO—, RCONH—, $RSO_2NH$—, RNH—, RS— or ROCONH. X is preferably a halogen atom, an acylamino group, an imido group, an aliphatic or aromatic sulfonamido group, a 5- or 6-membered nitrogen-containing heterocyclic group to be joined to the active site of coupling through the nitrogen, an aryloxy group or an alkoxy group.

In the above, R preferably represents a substituted or unsubstituted aliphatic, aromatic or heterocyclic group.

In formula (IV), the substituent on the phenyl group of the N-phenylcarbamoyl group $R_8$ may be selected from the group of the substituents described for $R_1$. Where there are two or more substituents, they may be the same or different.

A preferred example of $R_8$ is represented by the following formula (IV-A).

(IV-A)

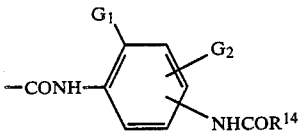

In formula (IV-A), $G_1$ represents a halogen atom or an alkoxy group; $G_2$ represents a hydrogen atom, a halogen atom or an alkoxy group which may optionally have a substituent; and $R^{14}$ represents an alkyl group which may optionally contain a substituent.

The substituents for $G_2$ and $R^{14}$ in formula (IV-A) typically include, for example, alkyl groups, alkoxy groups, aryl groups, aryloxy groups, amino groups, dialkylamino groups, heterocyclic groups (such as N-morpholino, N-piperidino and 2-furyl groups), halogen atoms, nitro groups, hydroxyl groups, carboxyl groups, sulfo groups, and alkoxycarbonyl groups.

Preferred split-off groups $Y_4$ include groups represented by the following formulae (X) to (XVI).

(X)

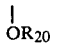

wherein $R_{20}$ represents an aryl or heterocyclic group which may be substituted.

(XI)

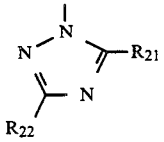

(XII)

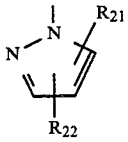

In formulae (XI) and (XII), each of $R_{21}$ and $R_{22}$ represents a hydrogen atom, a halogen atom, a carboxylic acid ester group, an amino group, an alkyl group, an alkylthio group, an alkoxy group, an alkylsulfonyl group, an alkylsulfinyl group, a carboxylic acid group, a sulfonic acid group, or a substituted or unsubstituted phenyl or heterocyclic group. $R_{21}$ and $R_{22}$ may be identical or different.

(XIII)

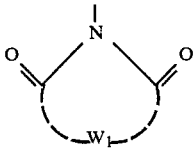

wherein $W_1$ represents a non-metallic atomic group required to form a 4-, 5- or 6-membered ring together with

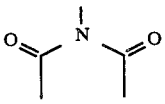

in the formula. Specifically, $W_1$ is an atom selected from the group consisting of carbon, sulfur, oxygen, and nitrogen. As the ring formed, 5- or 6-membered rings are preferred, and examples include N-phthalimidyl, N-succinimidyl, N-maleimidyl, N-glutarimidyl, 1,2-cyclohexanedicarboximid-N-yl, 1-cyclohexene-1,2-dicarboximid-N-yl, 3-cyclohexene-1,2-dicarboximid-N-yl, malonimid-N-yl, hydantoin-N-yl, 2,5-oxazolidinedion-N-yl, tetrahydro-1,4-oxazin-3,5-dion-4-yl, thiazolidin-2,4-dion-3-yl, and 1,2,4-triazolidin-3,5-dion-4-yl, which may have substituents on the atoms which can be substituted.

Among the groups of formula (XIII), preferred are those of the following formulae (XIV) to (XVI).

(XIV)

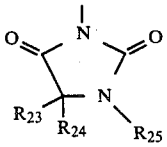

(XV)

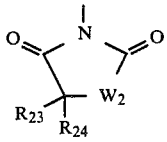

(XVI)

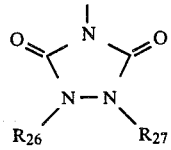

In the above formulae (XIV) to (XVI), each of $R_{23}$ and $R_{24}$ represents a hydrogen atom, an alkyl group, an aryl group, an alkoxy group, an aryloxy group or a hydroxyl group; each of $R_{25}$, $R_{26}$ and $R_{27}$ represents a hydrogen atom, an alkyl group, an aryl group, an aralkyl group or an acyl group; and $W_2$ represents an oxygen or sulfur atom.

Some literature references which describe other examples of the couplers represented by formulae (I) to (IX) or methods of their synthesis are cited below. The compounds of formula (I) are described, for example, in Japanese Patent Application (OPI) No. 80045/81. The compounds of formula (II) are described, for example, in Japanese Patent Application (OPI) Nos. 111631/74 and 126833/81 and U.S. Pat. No. 4,351,897. The compounds of formula (IV) are described, for example, in Japanese Patent Application (OPI) No. 48541/79, Japanese Patent Publication No. 10739/83, U.S. Pat. No. 4,326,024, and *Research Disclosure,* 18053. The compounds of formula (V) are described, for example, in Japanese Patent Application (OPI) No. 162548/84. The compounds of formula (VI) are described, for example, in Japanese Patent Application No. 151354/83. The compounds of formula (VII) are described, for example, in Japanese Patent Publication No. 27411/72. The compounds of formula (VIII) are described, for example, in Japanese Patent Application (OPI) No. 171956/84 and Japanese Patent Application No. 27745/84. The compounds of formula (IX) are described, for example, in Japanese Patent Application No. 142801/83. The highly color forming ballast groups described, for example, in Japanese Patent Application (OPI) Nos. 42045/83, 214854/84, 177553/84, 177554/84, and 177557/84 can be linked to any of the compounds of formulae (I) to (IX).

Since the 5,5N-heterocyclic couplers of formula (III) give a magenta dye with small amounts of unwanted yellow subsidiary absorption components by coupling with the oxidation product of a color developing agent as compared with the 5-pyrazolone type couplers of formula (II), they can give color prints which are better in color separation and color reproduction. Previously, a magenta dye which has little yellow subsidiary absorption which has sharply decreasing absorptions on the long wavelength side has been desired. The couplers of formula (III) form such a dye.

Among the 5,5N-heterocyclic couplers of formulae (V) to (IX), those couplers which give dyes of such particularly favorable hues fall within formulae (V), (VII) and (VIII). The couplers of formulae (V), (VI), (VIII) and (IX) give magenta dyes having higher light fastness than do the couplers of formula (VII). Generally, the 1H-pyrazolo[1,5-b][1,2,4]triazole-type couplers of formula (VIII) are superior in all respects in regard to the spectral absorptions of magenta dyes formed, light and heat fastness characteristics and color fading balance.

Specific examples of the compounds of formulae (I), (II) or (III), and (IV) are shown below under the designation of (C-1), (M-1) and (Y-1) and subsequent numbers preceded by C, M and Y, respectively. It should be understood, however, that the invention is in no way limited to these exemplified compounds.

(C-1)

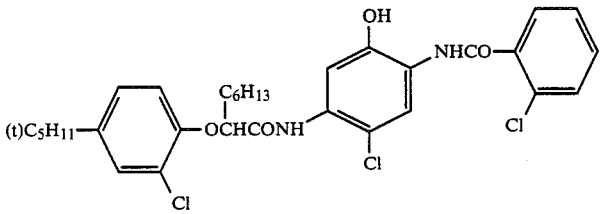

(C-2)

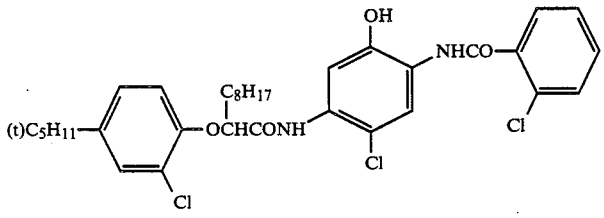

(C-3)

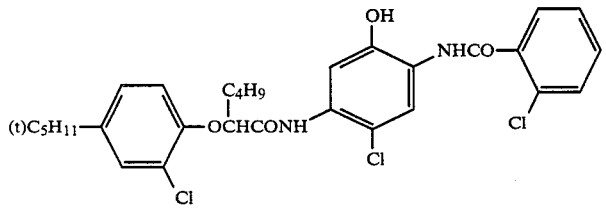

(C-4)

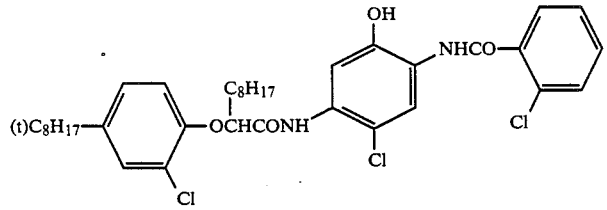

(C-5)

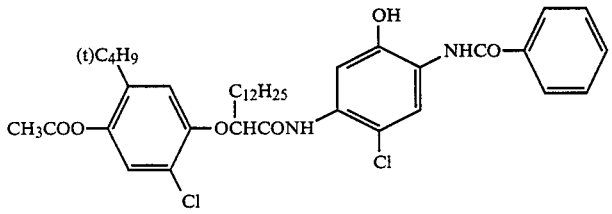

-continued
(C-6)
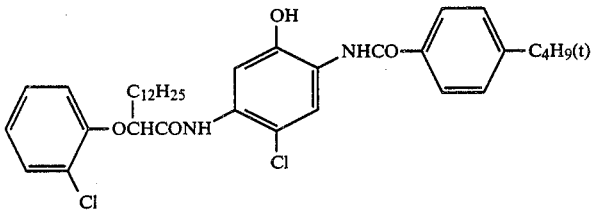
(C-7)
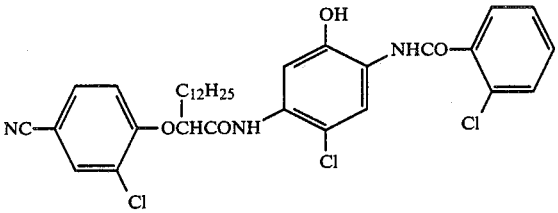
(C-8)
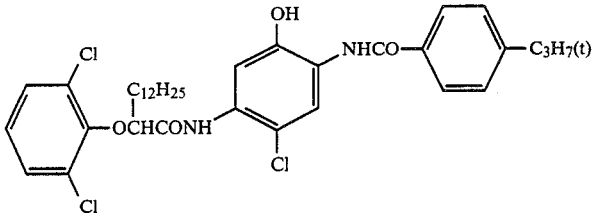
(C-9)
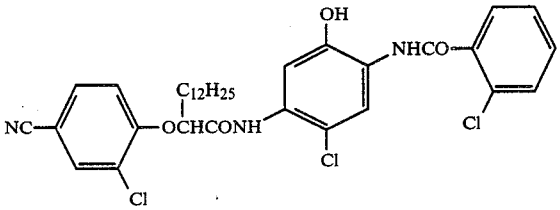
(C-10)
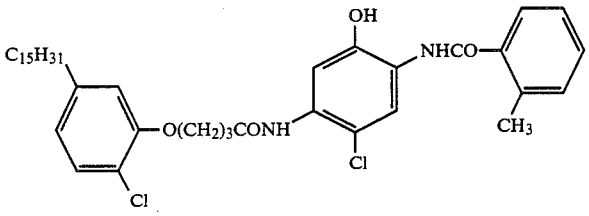
(C-12)
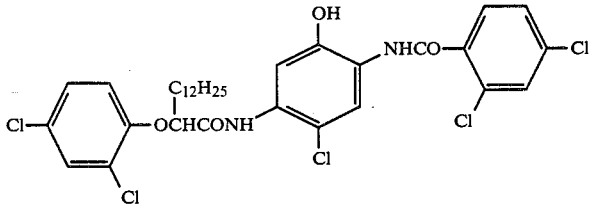
(C-13)
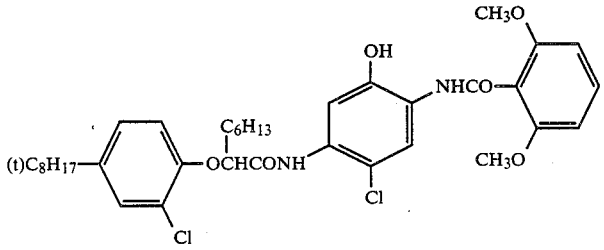

-continued
(C-14)
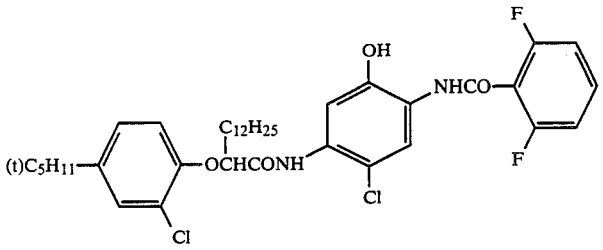
(C-15)
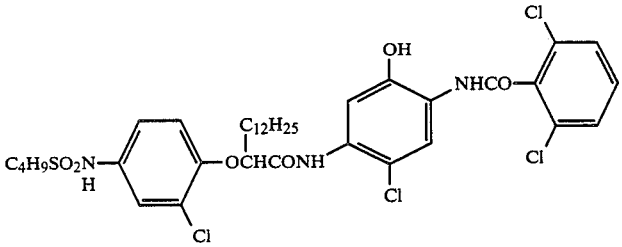
(C-16)
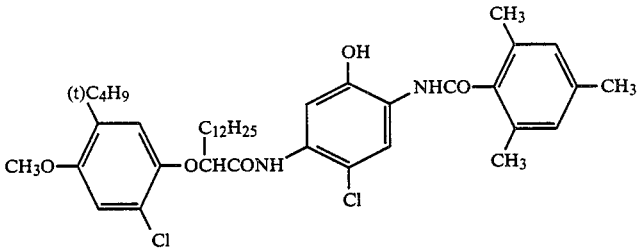
(C-17)
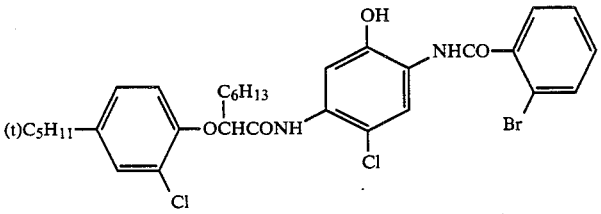
(C-18)
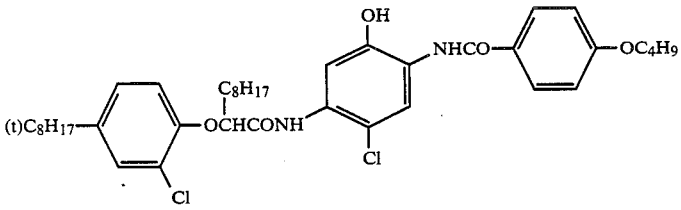
(C-19)
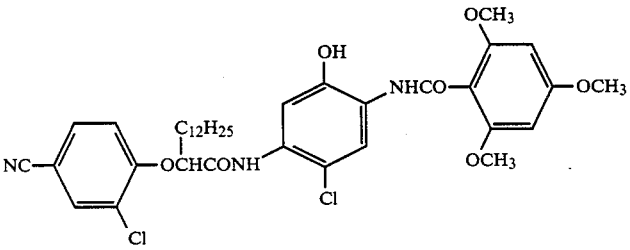

-continued
(C-20)
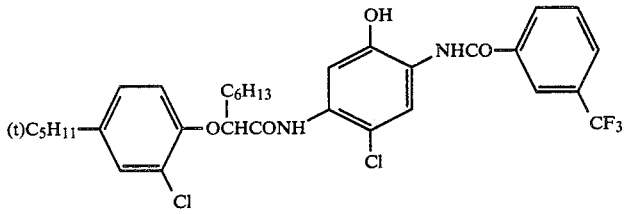
(C-21)
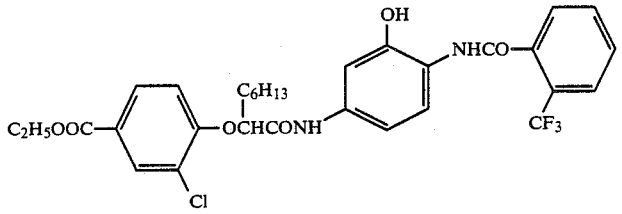
(C-22)
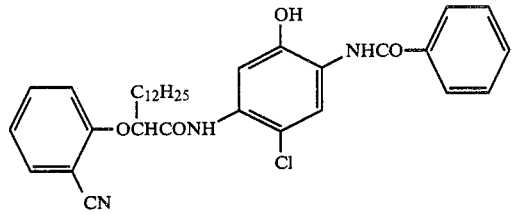
(C-23)
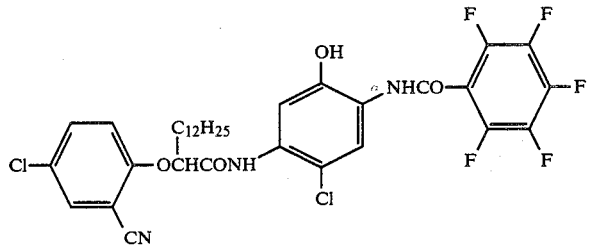
(C-24)
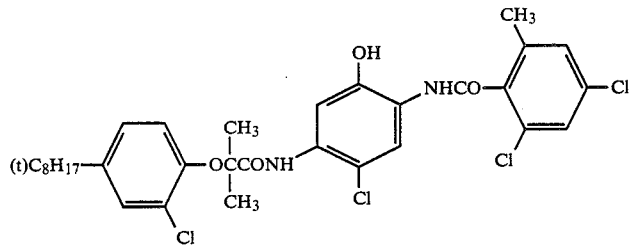
(C-25)
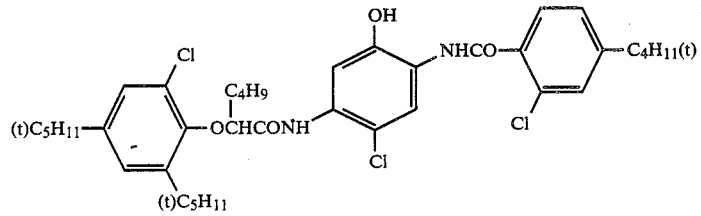

-continued
(M-1)
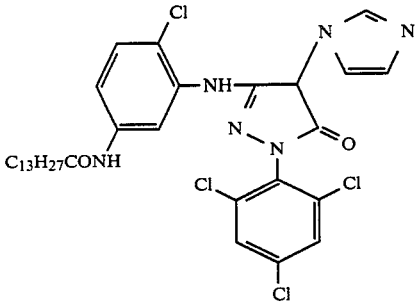
(M-2)
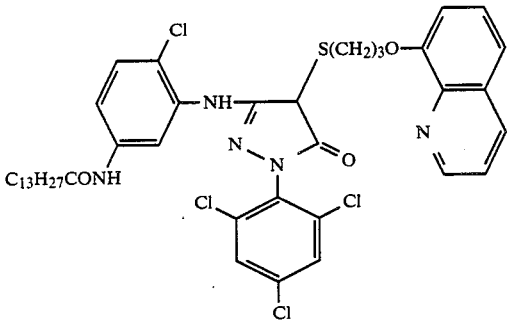
(M-3)
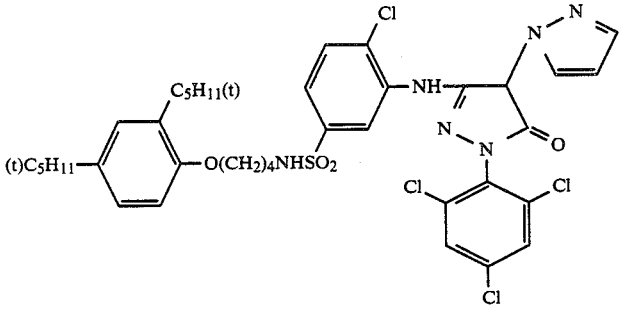
(M-4)
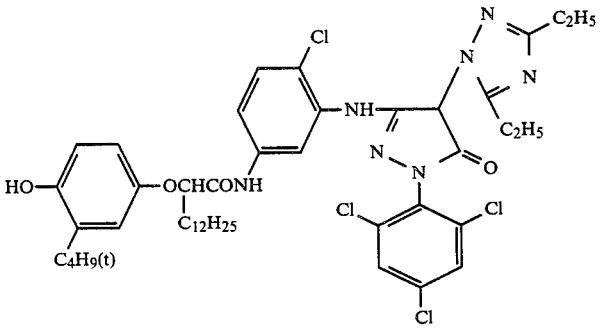
(M-5)
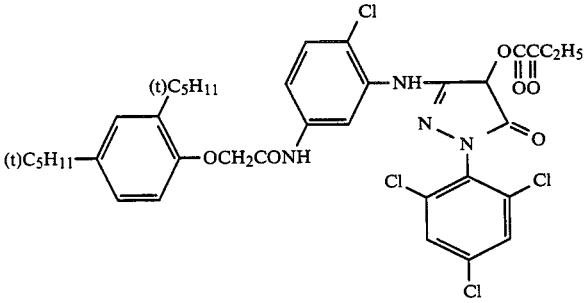

-continued
(M-6)
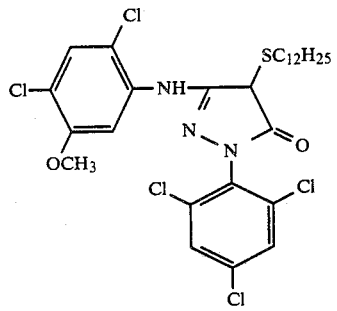
(M-7)
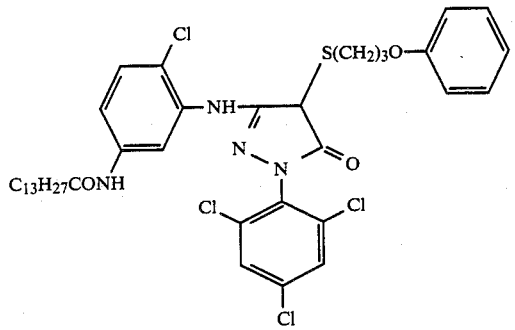
(M-8)
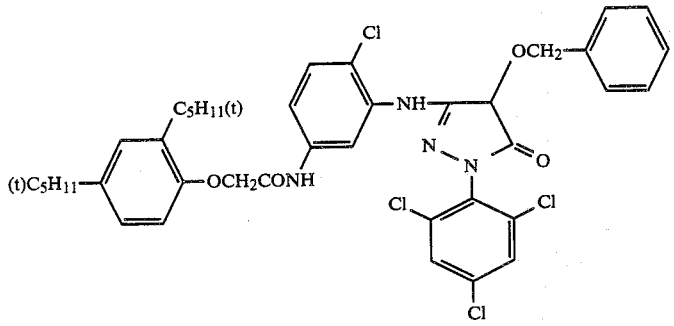
(M-9)
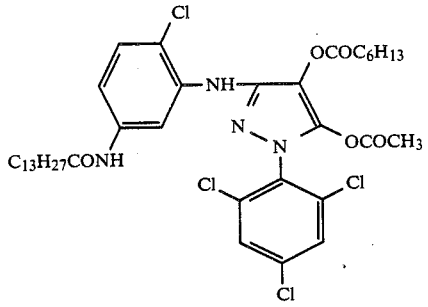
(M-10)
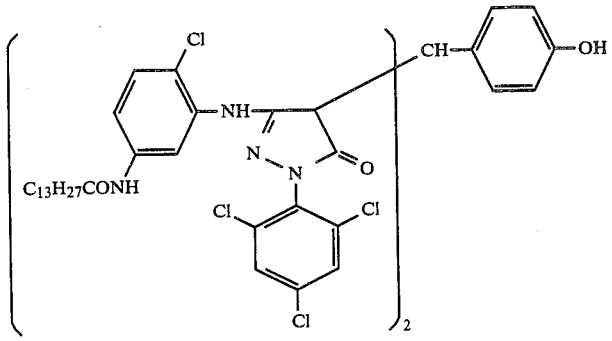

-continued
(M-11)
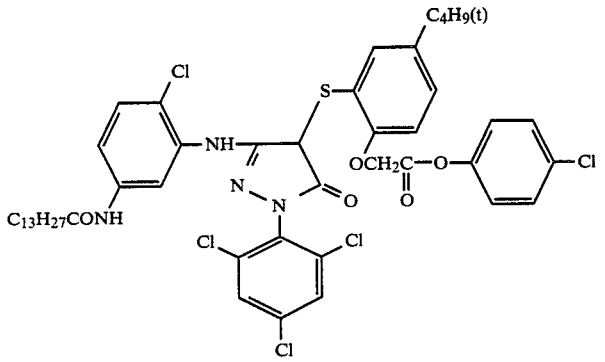
(M-12)
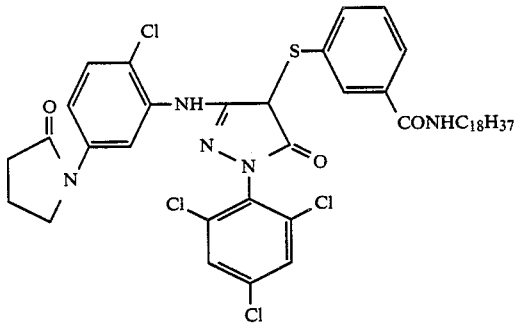
(M-13)
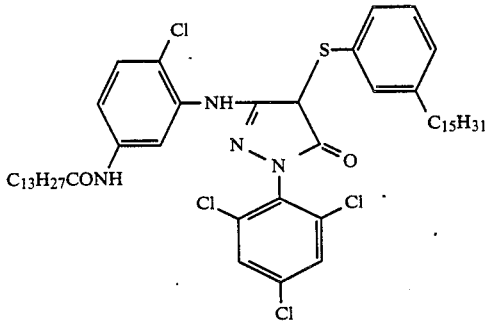
(M-14)
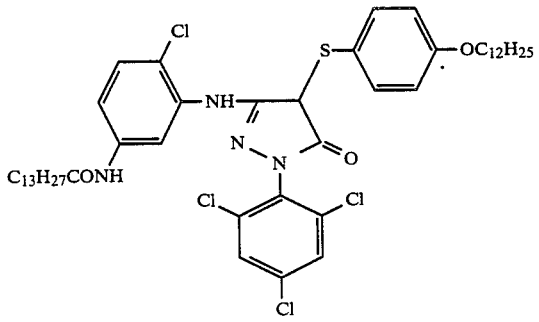

-continued
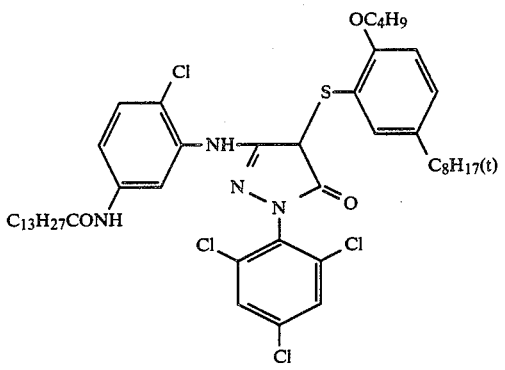
(M-15)
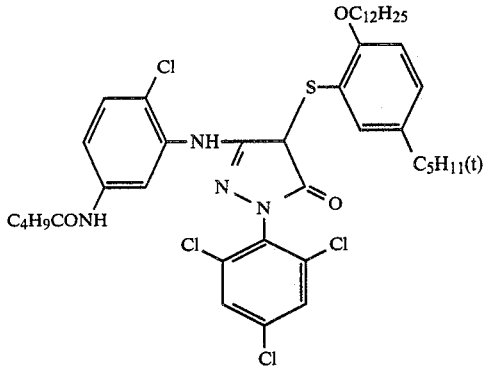
(M-16)
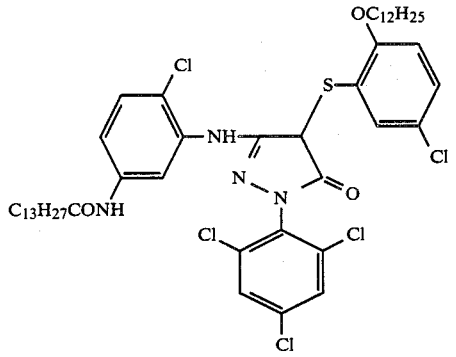
(M-17)
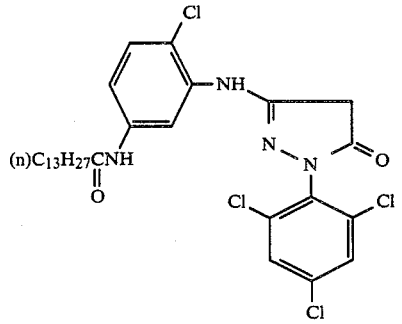
(M-18)

-continued
(M-19)
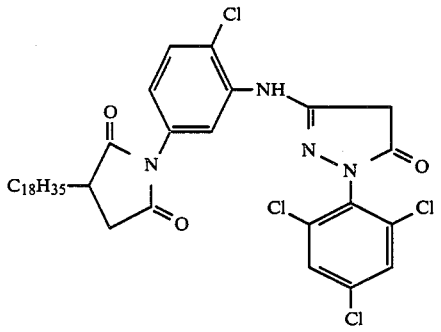
(M-20)
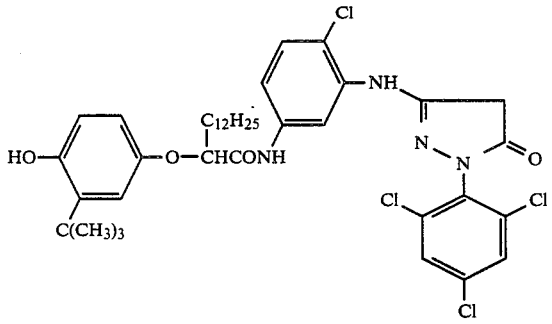
(M-21)
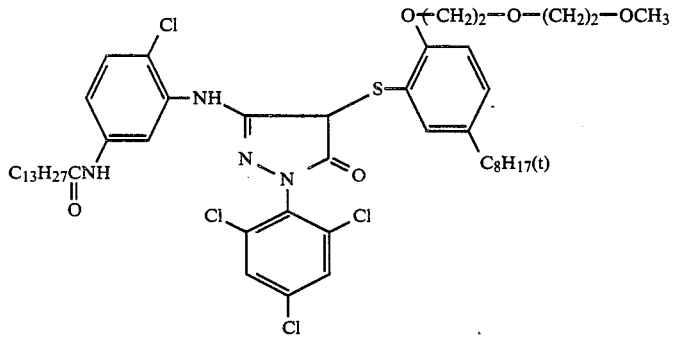
(M-22)
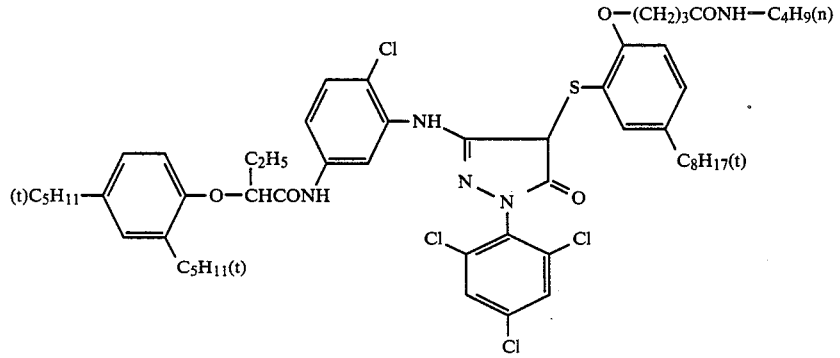

-continued
(M-23)
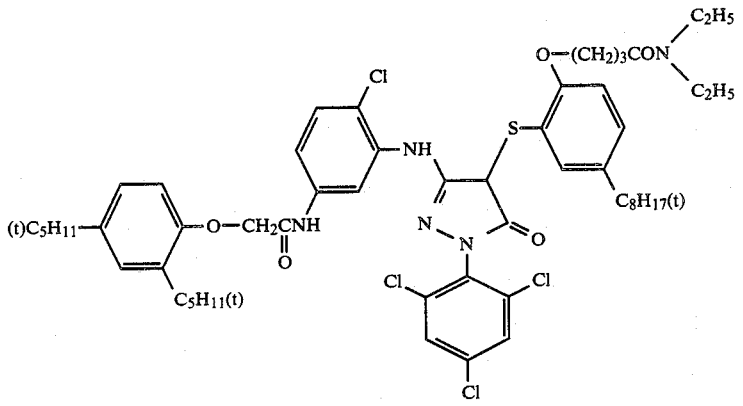
(M-24)
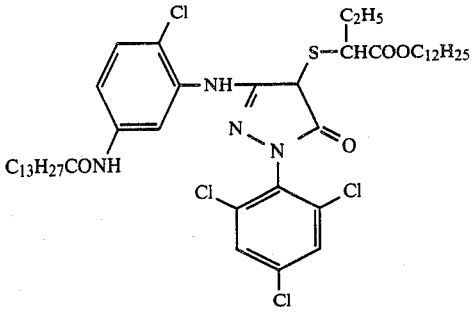
(M-25)
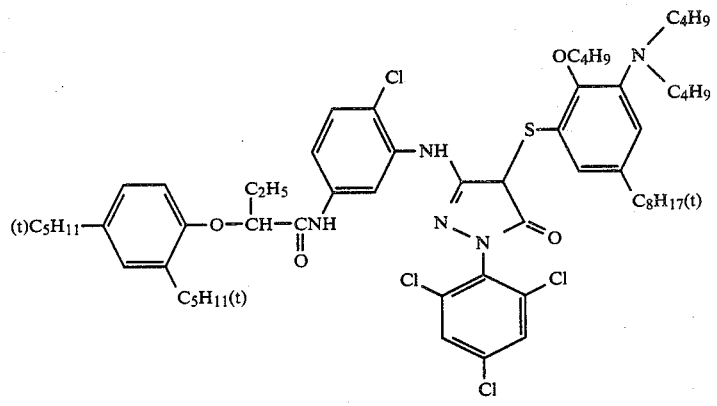
(M-26)
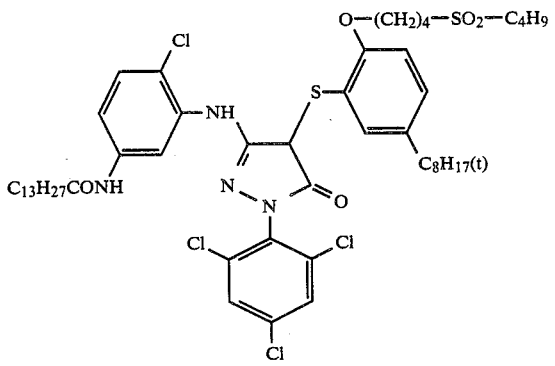

-continued
(M-27)
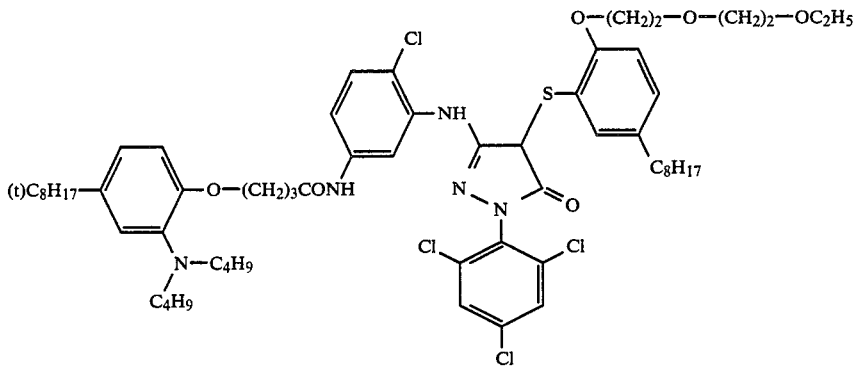
(M-28)
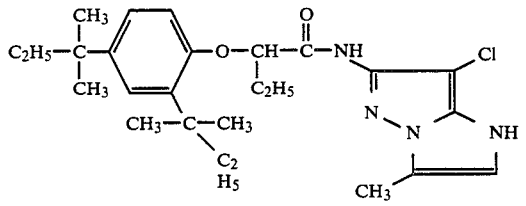
(M-29)
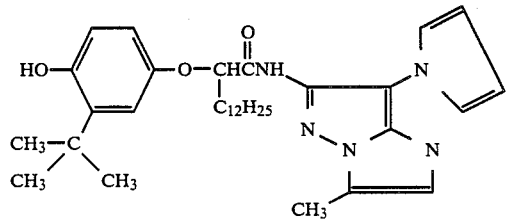
(M-30)
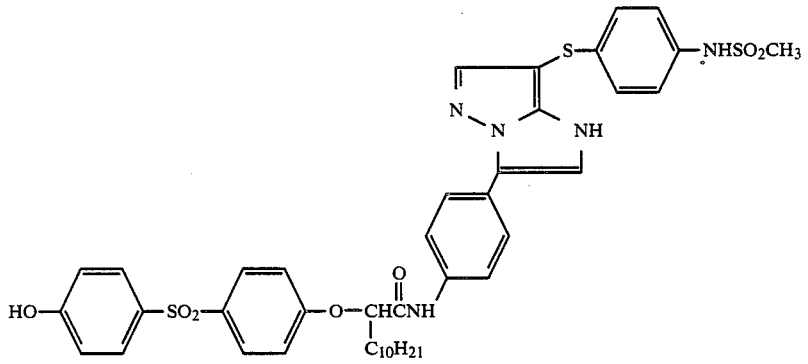
(M-31)
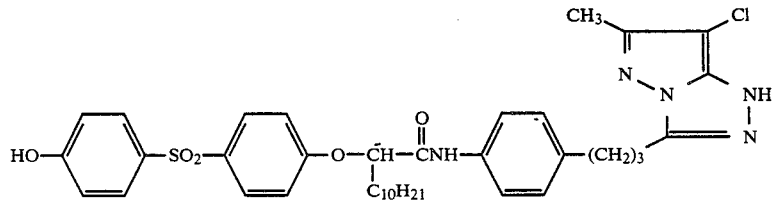

-continued
(M-32)
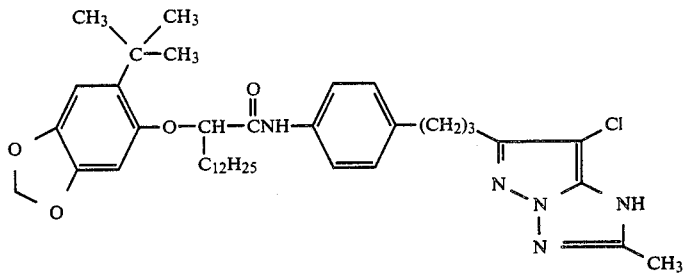
(M-33)
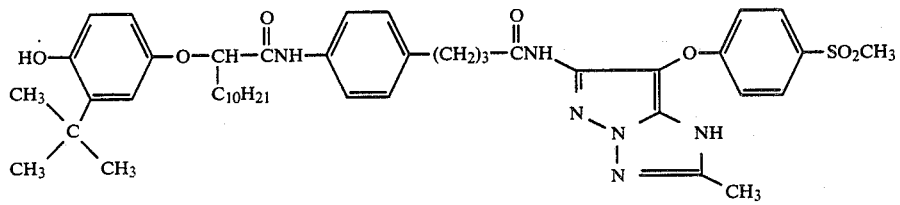
(M-34)
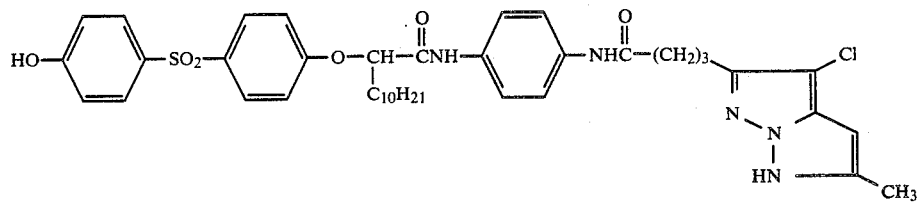
(M-35)
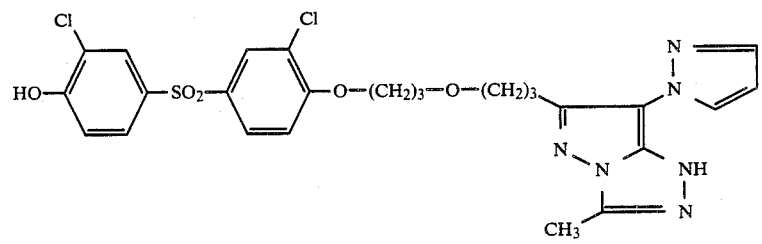
(M-36)
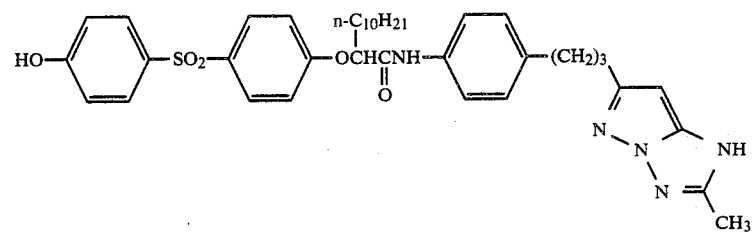
(M-37)
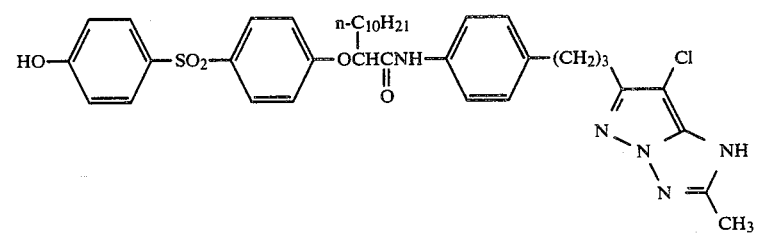

-continued
(M-38)
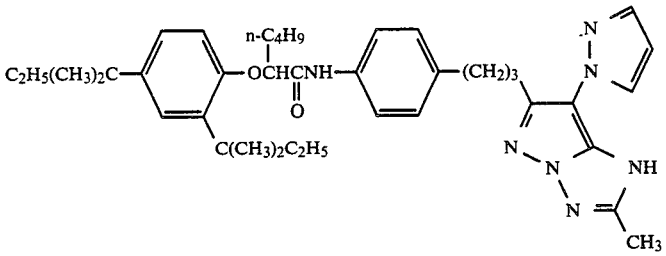
(M-39)
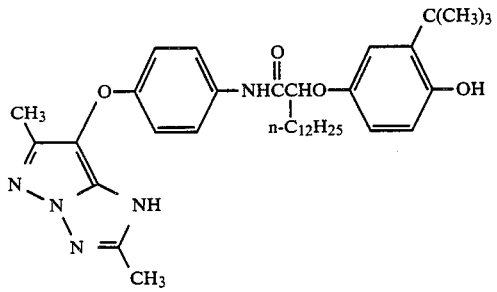
(M-40)
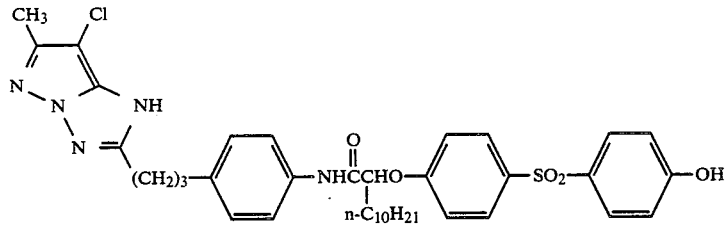
(M-41)
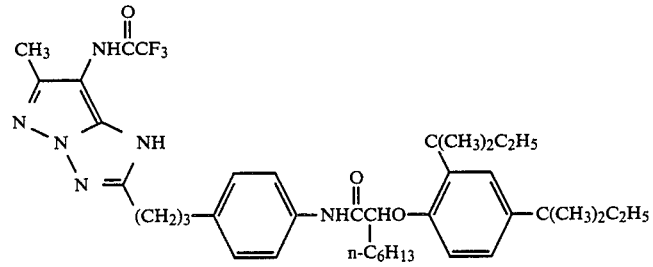
(M-42)
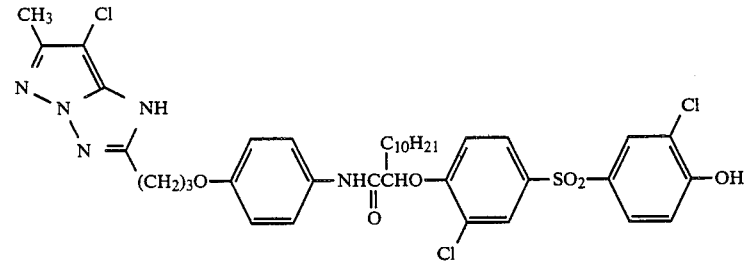
(M-43)
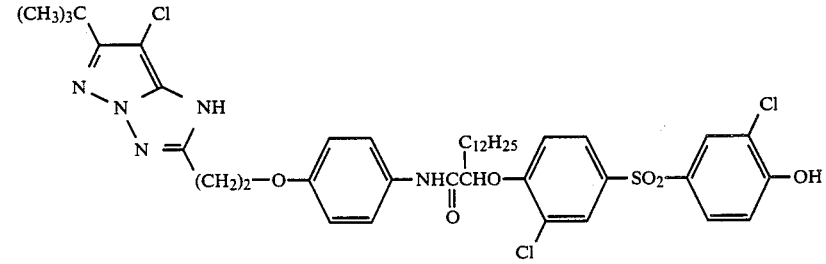

-continued
(M-44)
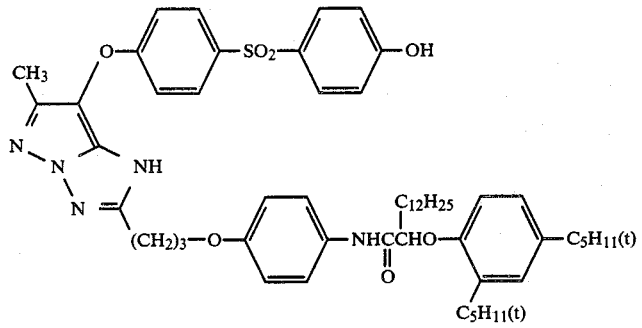
(M-45)
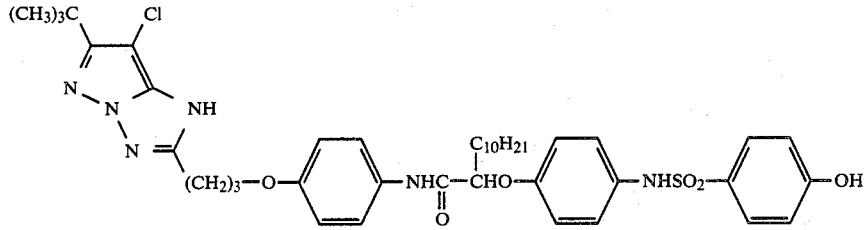
(M-46)
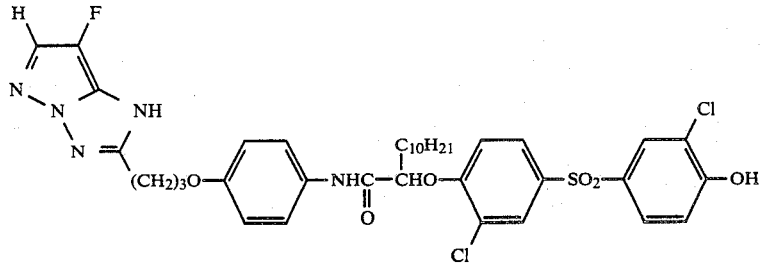
(M-47)
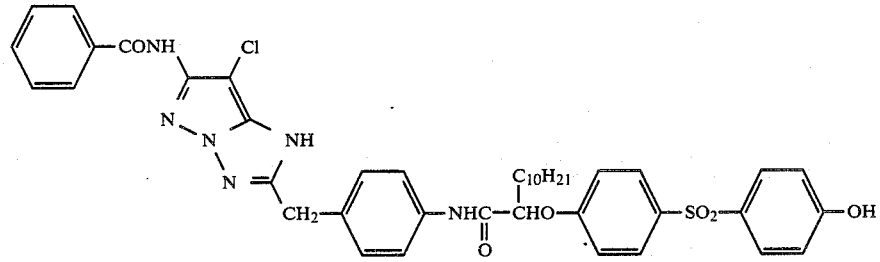
(M-48)
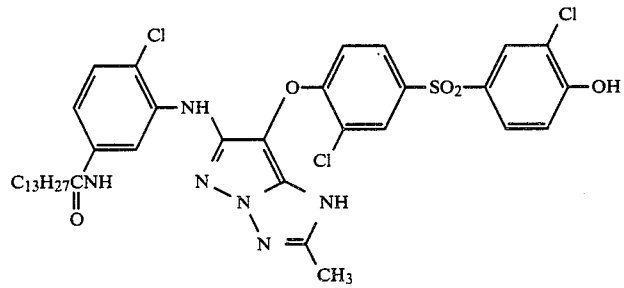
(M-49)
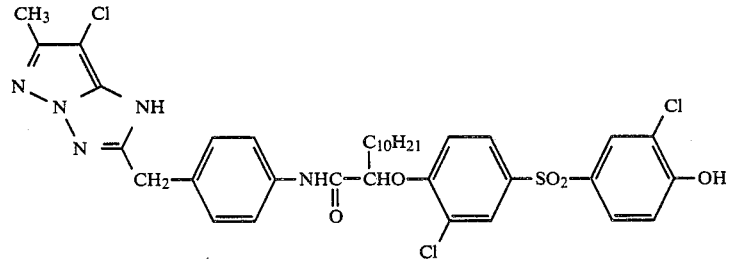

-continued
(M-50)
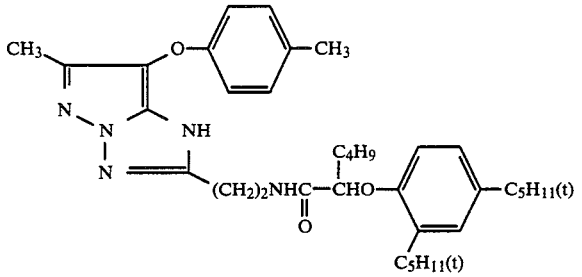
(M-51)
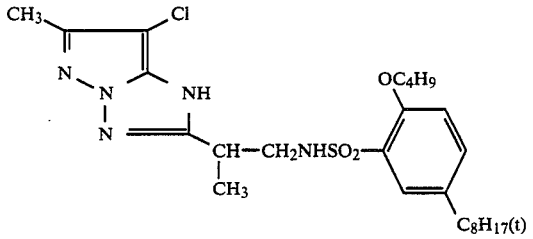
(M-52)
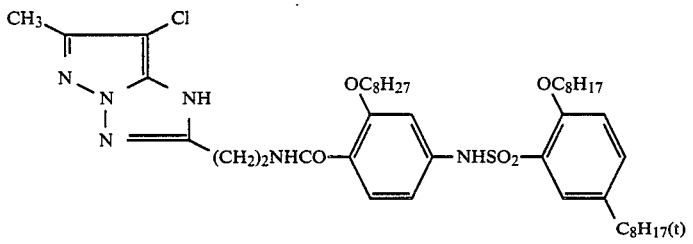
(Y-1)
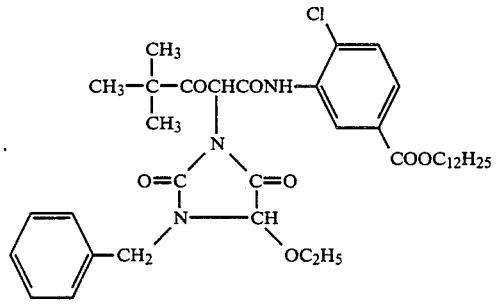
(Y-2)
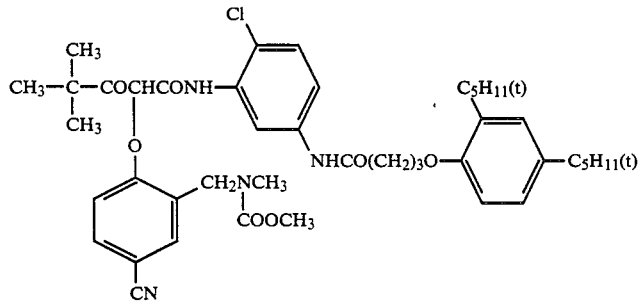
(Y-3)
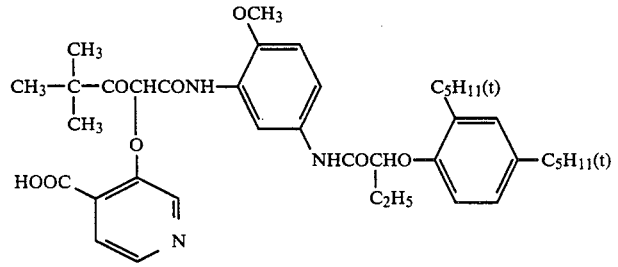

-continued
(Y-4)
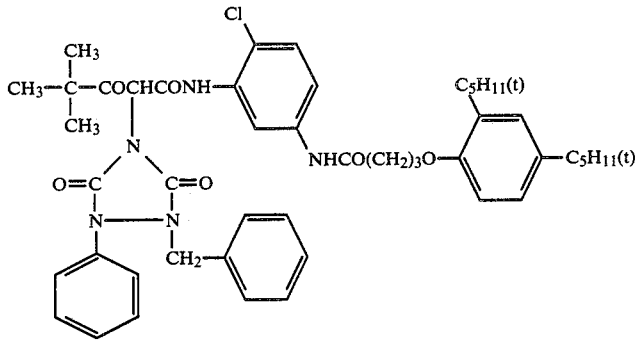
(Y-5)
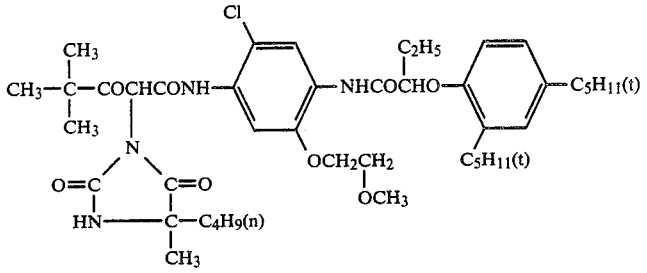
(Y-6)
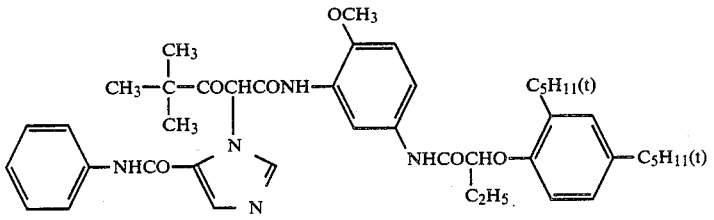
(Y-7)
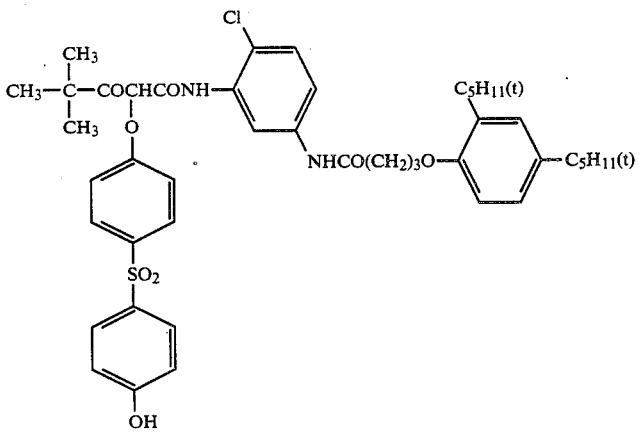

-continued
(Y-8)
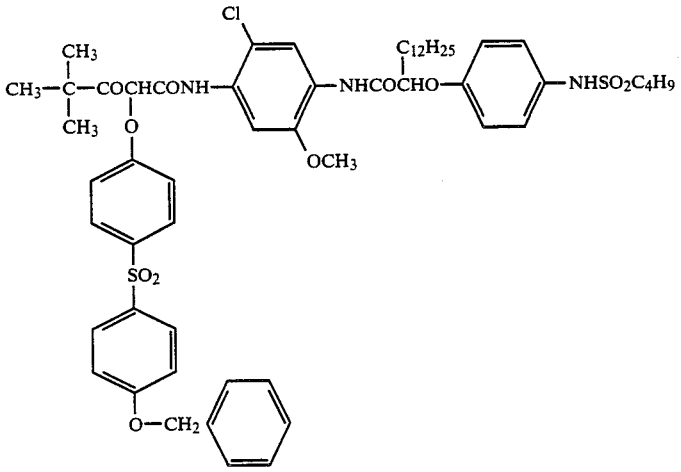
(Y-9)
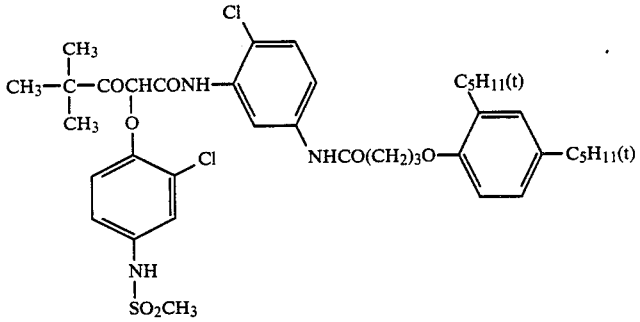
(Y-10)
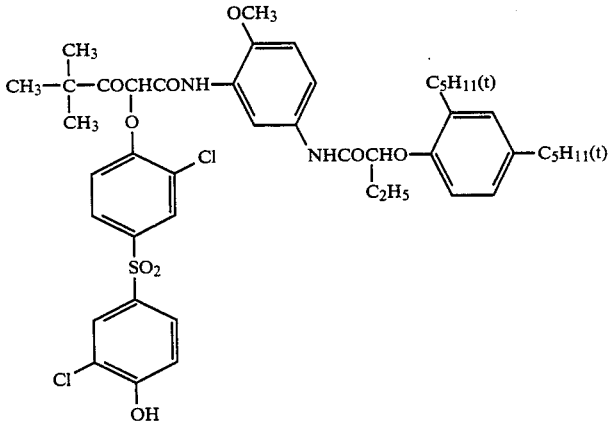
(Y-11)
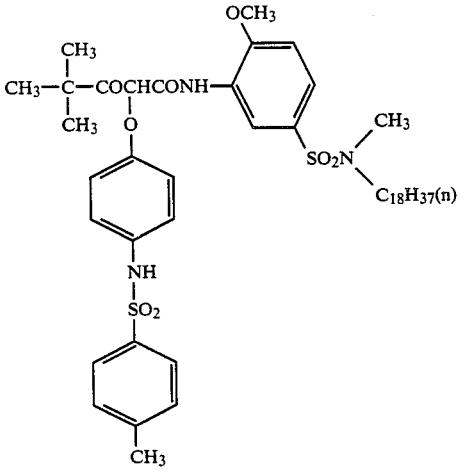

-continued
(Y-12)
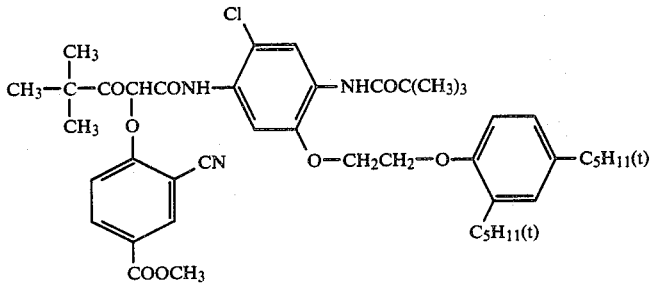
(Y-13)
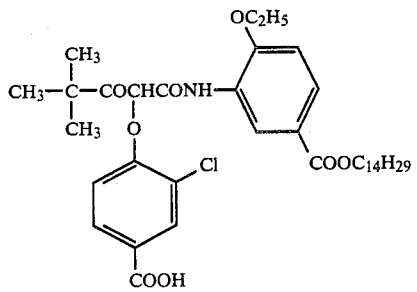
(Y-14)
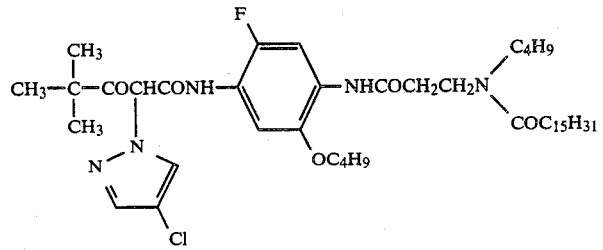
(Y-15)
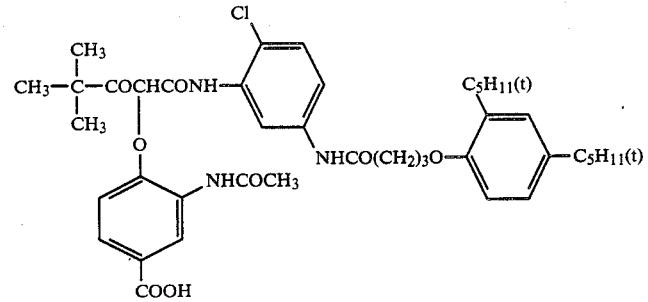
(Y-16)
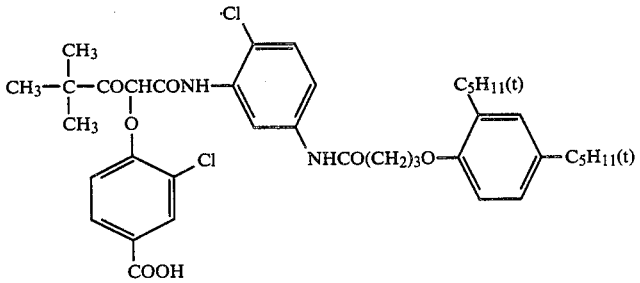

-continued
(Y-17)
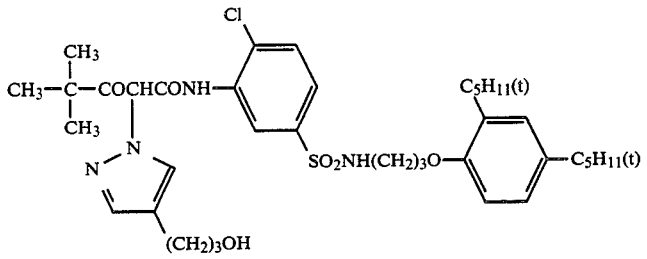
(Y-18)
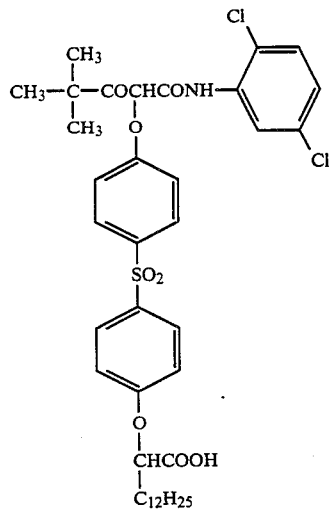
(Y-19)
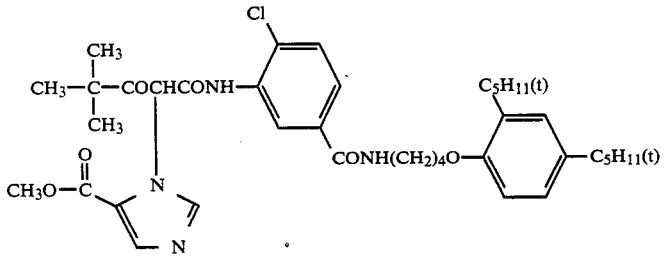
(Y-20)
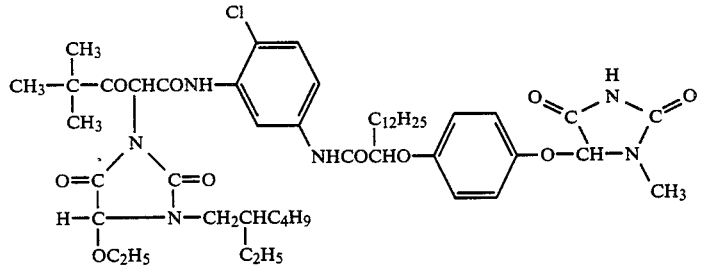
(Y-21)
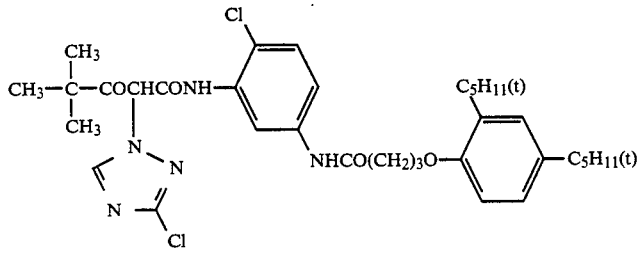

-continued
(Y-22)
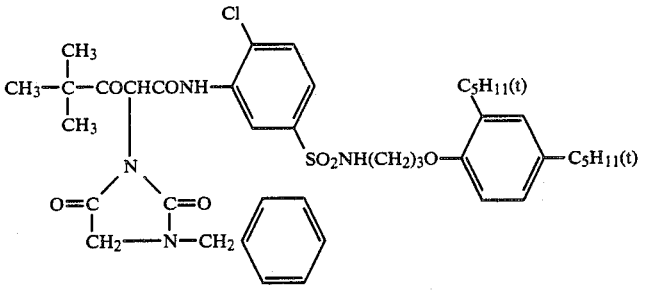
(Y-23)
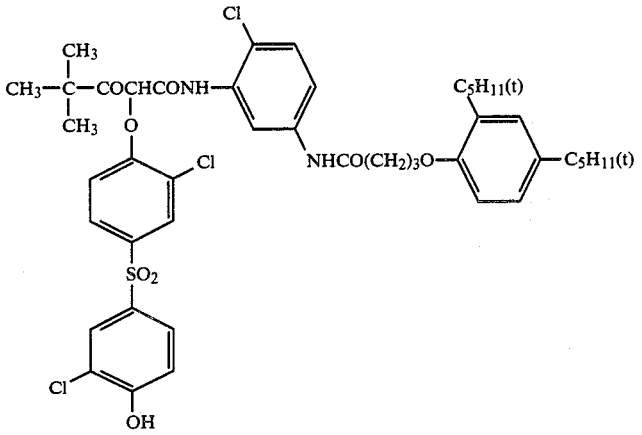
(Y-24)
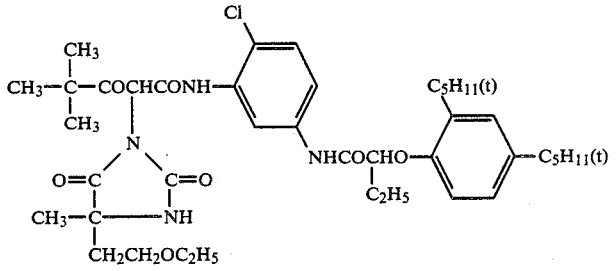
(Y-25)
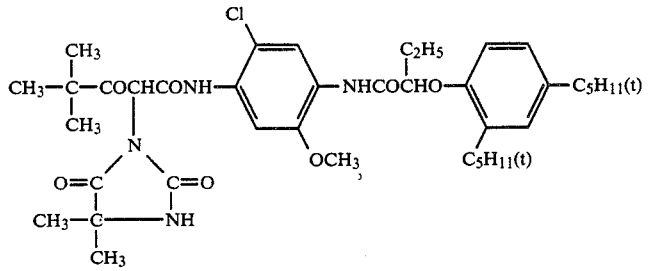
(Y-26)
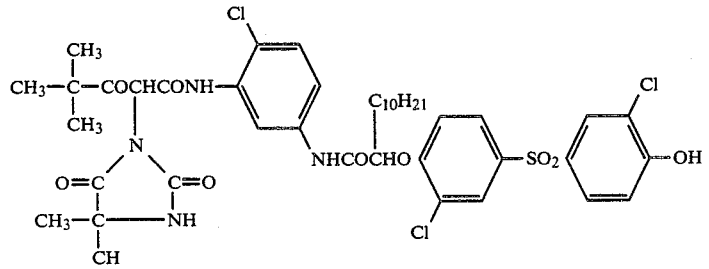

-continued
(Y-27)
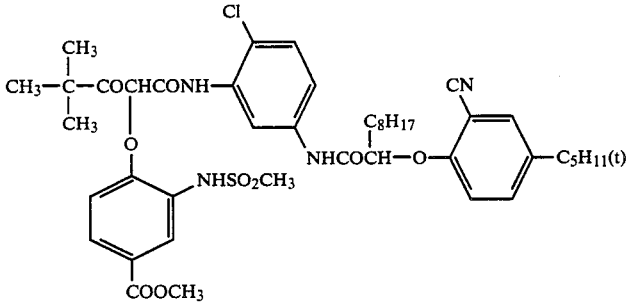
(Y-28)
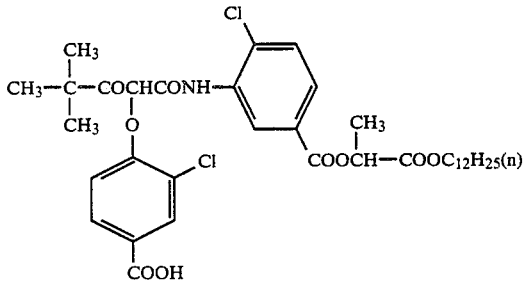
(Y-29)
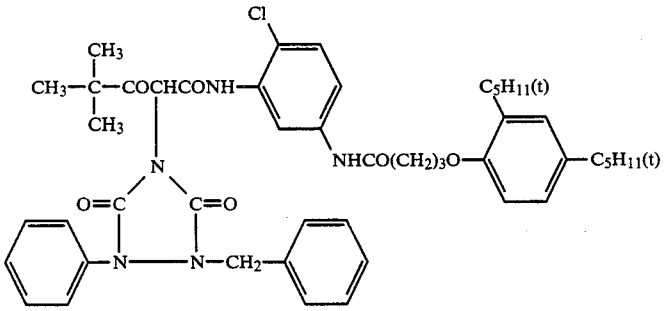
(Y-30)
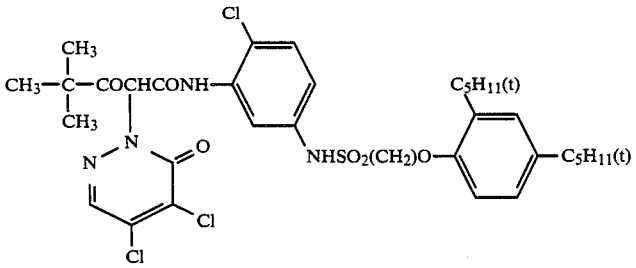
(Y-31)
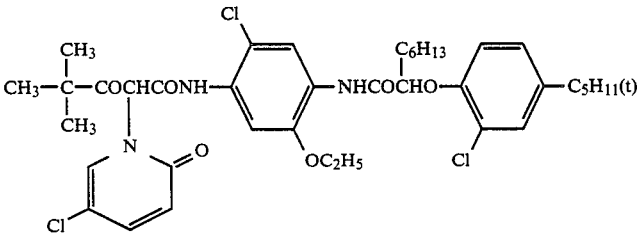

-continued
(Y-32)
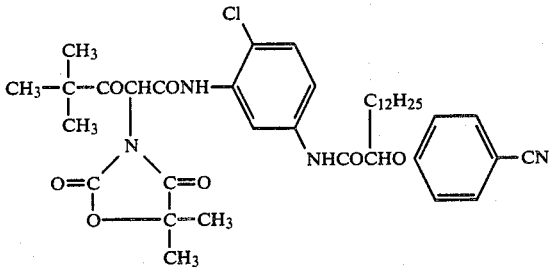
(Y-33)
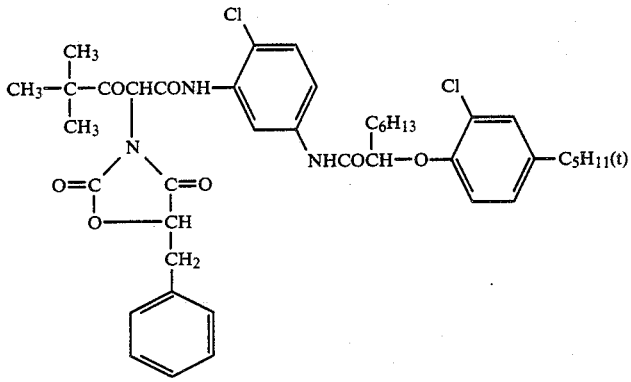
(Y-34)
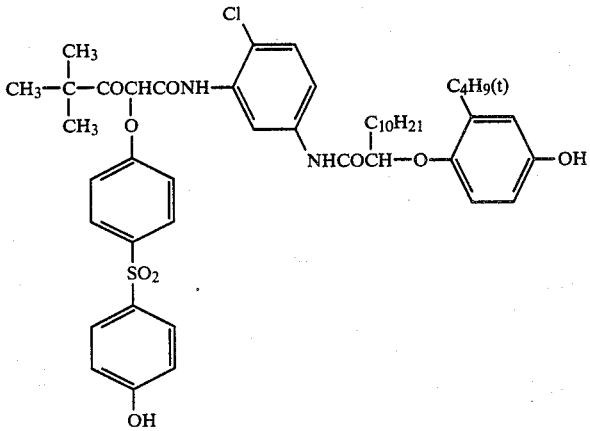
(Y-35)
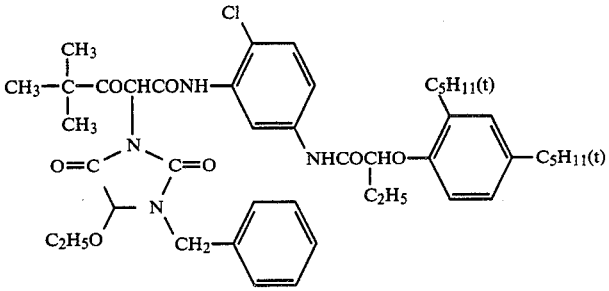
(Y-36)
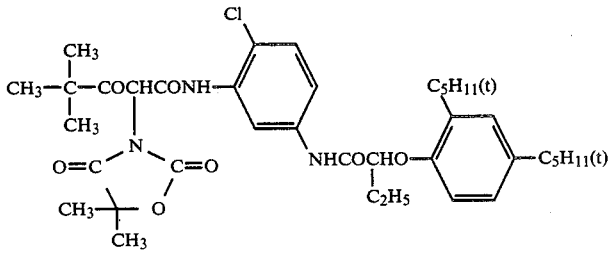

-continued (Y-37)

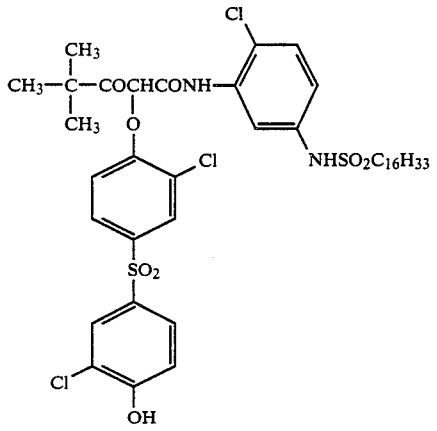

(Y-38)

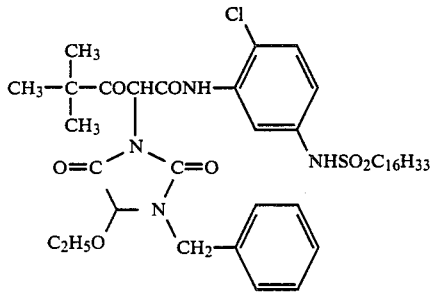

(Y-39)

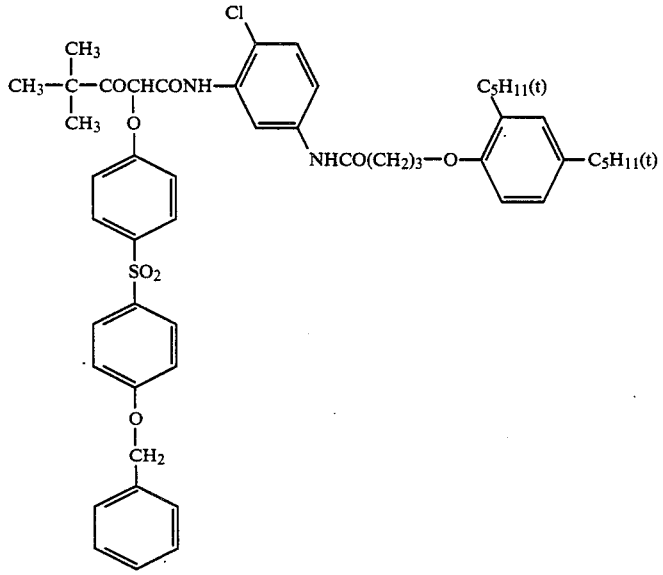

A preferred embodiment of this invention is a photographic silver halide light-sensitive material, wherein a blue-sensitive silver halide layer contains at least one coupler represented by formula (IV), a green-sensitive silver halide layer contains at least one coupler represented by formula (II) or (III), and a red-sensitive silver halide layer contains at least one coupler represented by formula (I).

The couplers represented by formulae (I), (II) or (III), and (IV) are included in silver halide emulsion layers constituting light-sensitive layers each in an amount of 0.1 to 1.0 mole, preferably 0.1 to 0.5 mole, per mole of silver halide. The mole ratio of the couplers of formulae (I), (II) or (III), and (IV) is in many cases in the range of about 1:0.2–1.5:0.5–1.5. The photographic materials can also be designed outside this range.

To add the couplers to the light-sensitive layers in this invention, various known techniques can be applied. Usually, they can be added by a method of dispersing oil droplets in water known as an oil protecting method. For example, the couplers are dissolved in a high boiling organic solvent such as phthalic acid esters (e.g., dibutyl phthalate and dioctyl phthalate), and phosphoric acid esters (e.g., tricresyl phosphate and trinonyl phosphate), or a low boiling organic solvent such as ethyl acetate, and the solution is dispersed in an aqueous solution of gelatin containing a surface active agent. Or it is also possible to add water or an aqueous solution of gelatin to a solution of the coupler containing a surface active agent, thereby forming an oil-in-water dispersion with phase inversion. An alkali-soluble coupler can also be dispersed by the so-called Fischer dispersing method. It is also possible to remove the low boiling organic solvent from the coupler dispersion by distillation, noodle washing, ultrafiltration, etc., and then mixing it with a photographic emulsion.

To introduce the yellow coupler, magenta coupler and cyan coupler in accordance with this invention, it is possible to use, as required, high boiling organic solvents having a boiling point of at least 160° C., for example, alkyl phthalates such as dibutyl phthalate and dioctyl phthalate, phosphoric acid esters such as diphenyl phosphate, triphenyl phosphate, tricresyl phosphate and dioctylbutyl phosphate, citrates such as tributyl acetylcitrate, benzoates such as octyl benzoate, alkylamides such as diethyllaurylamide, fatty acid esters such as dibutoxyethyl succinate and dioctyl azelate, and phenols such as 2,4-di-tert-amylphenol, and low boiling organic solvents having a boiling point of 30° to 150° C., for example, lower alkyl acetates such as ethyl acetate and butyl acetate, ethyl propionate, secbutyl alcohol, methyl iosbutyl ketone, β-ethoxyethyl acetate and methyl Cellosolve acetate, either singly or in combination.

Two or more couplers may be selected from the group of couplers of the same hue represented by formula (I), (II) or (III), or (IV), and used jointly. The couplers may be jointly emulsified, or they may be separately emulsified and then mixed. An anti-fading agent to be described below may be used as a mixture with the couplers.

The coupler of formula (I) may be mixed with other known cyan couplers, but the effect of the present invention is remarkable when the amount of the cyan coupler of the invention is at least 30 mole%, preferably at least 50 mole%, based on the total amount of cyan couplers used in one layer.

The phenolic cyan couplers, which have an alkyl group having at least 2 carbon atoms at the 5-position of the phenolic nucleus and which have an —NHCOY group in which Y is an alkaryloxyalkylidene group at the 2- position of the phenolic nucleus, described in U.S. Pat. No. 3,772,002, are preferred as the known cyan couplers to be used jointly. A typical example of such cyan couplers is 4,6-dichloro-5-ethyl-2-(2,4-di-tertamylphenoxypropylidenecarbonylamino)phenol.

To achieve the objects of this invention, the weight ratio of the high boiling organic solvent to the yellow coupler of this invention is preferably adjusted to not more than 1.0, particularly 0.1 to 0.8. The amount of the high boiling solvent in the magenta coupler and the cyan coupler is adjusted to an optimum value preferably by considering the solubility, the developability of the photographic material, etc. Usually, the amount of the high boiling organic solvent is set at 10% to 300% based on the weight of the magenta coupler or cyan coupler of the invention.

As required, special couplers other than the couplers of the invention represented by the above formulae may be included in the photographic material of this invention. For example, a colored magenta coupler may be included in the green-sensitive emulsion layer to impart a masking effect. A development inhibitor releasing coupler (DIR coupler), hydroquinone capable of releasing a development inhibitor, etc., may be used together in the emulsion layers or layers adjacent thereto. The development inhibitor released from these compounds with the development brings about intra- and interlayer effects such as the increased sharpness of the image, finer grains of the image, and increased monochromatic saturation.

By adding a coupler, which releases a development inhibitor or nucleating agent with the progress of silver development, to the photographic emulsion layers or adjacent layers, such effects as increased photographic sensitivity, improvement of the graininess of the color image, and harder gradation can be obtained.

In the present invention, an ultraviolet light absorber may be added to any desired layer. Preferably, it is added to the layer containing the compound of formula (I) or an adjacent layer. Examples of the ultraviolet light absorber that can be used in this invention are a group of the compounds listed in VIII, C of *Research Disclosure,* 17643, preferably the benzotriazole derivatives of the following formula (XVII).

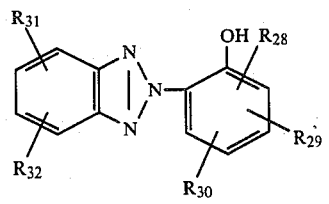

(XVII)

In formula (XVII), $R_{28}$, $R_{29}$, $R_{30}$, $R_{31}$ and $R_{32}$ may be identical or different and each represents a hydrogen atom or an aromatic group which may be substituted by the substituents described for $R_1$; and $R_{31}$ and $R_{32}$ may be cyclized to form a 5- or 6-membered aromatic ring composed of carbon atoms. Among these groups, those which can be substituted may further have the substituents described for $R_1$.

The compounds of formula (XVII) may be used singly or in combination. Typical examples of these compounds are shown below as UV-1 to UV-19.

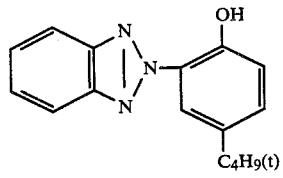

(UV-1)

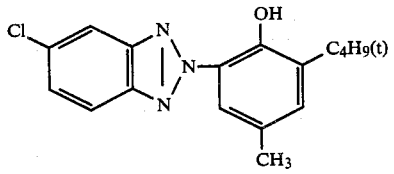

(UV-2)

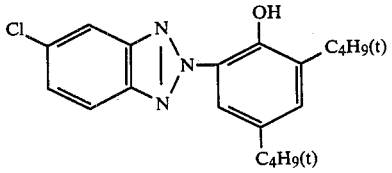

(UV-3)

-continued
(UV-4)
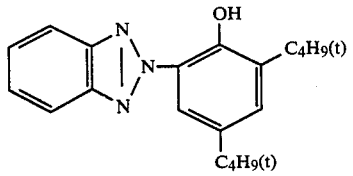
(UV-5)
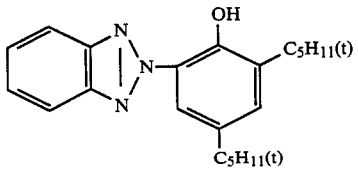
(UV-6)
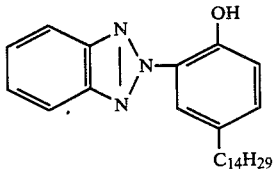
(UV-7)
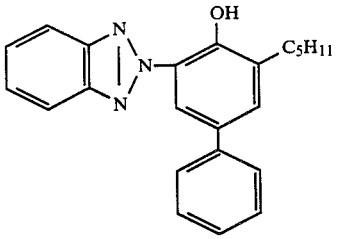
(UV-8)
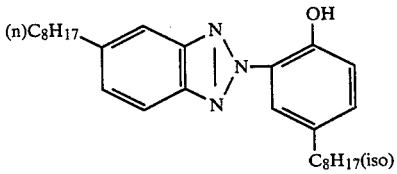
(UV-9)
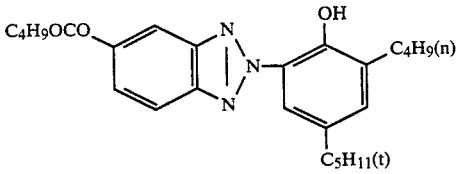
(UV-10)
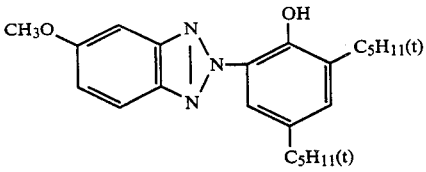
(UV-11)
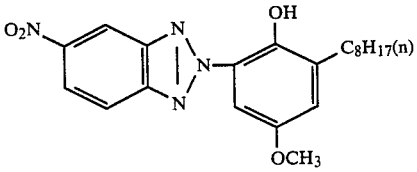
-continued
(UV-12)
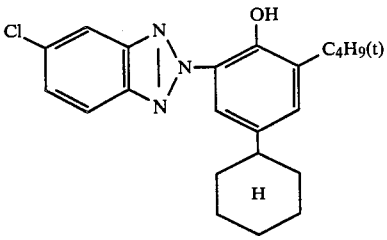
(UV-13)
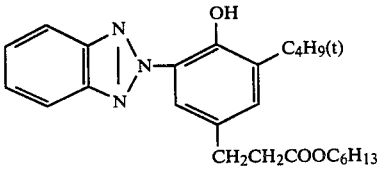
(UV-14)
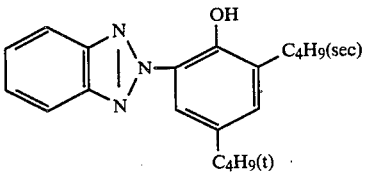
(UV-15)
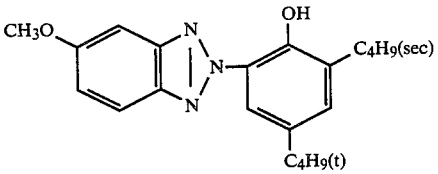
(UV-16)
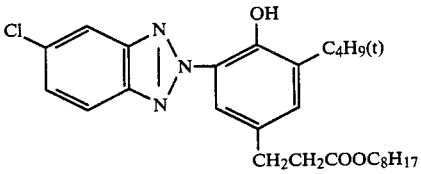
(UV-17)
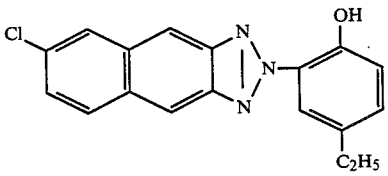
(UV-18)
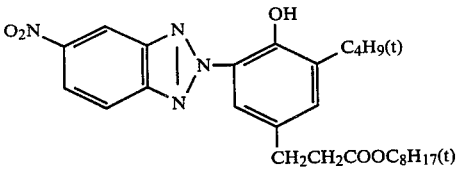
(UV-19)
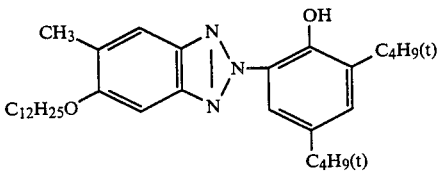

-continued (UV-20)

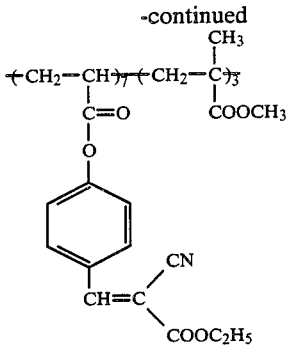

The methods of synthesizing the compounds of formula (XVII) or examples of other ultraviolet light absorber compounds are described, for example, in Japanese Patent Publication No. 29620/69, Japanese Patent Application (OPI) Nos. 151149/75 and 95233/79, U.S. Pat. No. 3,766,205, European Patent No. 0057160, and *Research Disclosure,* 22519 (1983, No. 225). The high molecular weight ultraviolet light absorbers described in Japanese Patent Application (OPI) Nos. 111942/83, 178351/83, 181041/83, 19945/84 and 23344/84. A specific example thereof is given above as UV-20. Low molecular weight and high molecular weight ultraviolet light absorbers may be used jointly.

The ultraviolet light absorber is dissolved in high boiling organic solvents and low boiling organic solvents either singly or as a mixture as in the case of the couplers, and dispersed in a hydrophilic colloid. There is no limitation on the amounts of the high boiling organic solvent and the ultraviolet light absorber. Usually, the high boiling organic solvent is used in an amount of 0 to 300% based on the weight of the ultraviolet light absorber. The use of those ultraviolet light absorbers which are liquid at room temperature alone or in combination is preferred.

The use of the ultraviolet light absorber of formula (XVII) together with the combination of the couplers in accordance with this invention can lead to an improvement in the preservability of the dye image, particularly the cyan dye image, especially its light fastness. The ultraviolet light absorber and the cyan coupler may be emulsified together.

The amount of the ultraviolet light absorber to be coated may be one which is sufficient to imprat light stability to the cyan dye image. If it is used in too large an amount, it may cause yellowing to the unexposed area (white area) of the color photographic material. Usually, therefore, it is adjusted preferably to $1\times10^{-4}$ mole/m$^2$ to $2\times10^{-3}$ mole/m$^2$, especially $5\times10^{-4}$ mole/m$^2$ to $1.5\times10^{-3}$ mole/m$^2$.

With the light-sensitive layer structure of an ordinary color paper, the ultraviolet light absorber is included in one, preferably both, of two layers adjacent the red-sensitive emulsion layer containing the cyan coupler. When the ultraviolet light absorber is added to an interlayer between the green-sensitive layer and the red-sensitive layer, it may be emulsified together with a color mixing preventing agent. When the ultraviolet light absorber is added to a protective layer, another protective layer may be coated as the outermost layer. This protective layer may contain a matting agent of any desired particle size.

To increase the preservability of dye images formed, especially yellow and magenta images, an anti-fading agent, such as various organic compounds and metal complexes, may be used together. Examples of the organic anti-fading agent include hydroquinones, gallic acid derivatives, p-alkoxyphenols, and p-oxyphenols. Dye image stabilizers, stain preventing agents or antioxidants that may be used in this invention are disclosed in the patents cited in paragraphs I to J, VII of *Research Disclosure,* 17643. The anti-fading agents of the metal complex type are described, for example, in *Research Disclosure,* 15162.

To improve the fastness of the yellow image to heat and light, there may be used many compounds which fall within phenols, hydroquinones, hydroxycoumarones, hydroxycoumarans, hindered amines, and their alkyl ethers, silyl ethers or hydrolyzable precursor derivatives. The compounds of the following formulae (XVIII) and (XIX) effectively improve simultaneously the light and heat fastness characteristics of the yellow images obtained from the couplers of formula (IV).

(XVIII)

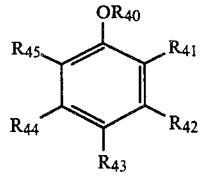

(XIX)

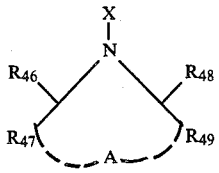

In formulae (XVIII) and (XIX), $R_{40}$ represents a hydrogen atom, an aliphatic group, an aromatic group, a heterocyclic group or a substituted silyl group of the formula

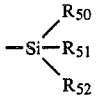

in which $R_{50}$, $R_{51}$ and $R_{52}$ may be identical or different and each represents an aliphatic group, an aromatic group, an aliphatic oxy group or an aromatic oxy group. These groups may have the substituents described for $R_1$. $R_{41}$, $R_{42}$, $R_{43}$, $R_{44}$ and $R_{45}$ in formula (XVIII) may be identical or different and each represents a hydrogen atom, an alkyl group, an aryl group, an alkoxy group, a hydroxyl group, a mono- or dialkylamino group, an imino group or an acylamino group. In formula (XIX), $R_{46}$, $R_{47}$, $R_{48}$ and $R_{49}$ may be identical or different and each represents a hydrogen atom or an alkyl group; X represents a hydrogen atom, an aliphatic group, an acyl group, an aliphatic or aromatic sulfonyl group, an aliphatic or aromatic sulfinyl group, an oxy radical or a hydroxyl group; and A represents a non-metallic atomic group required to form a 5-, 6- or 7-membered ring.

Specific examples of the compounds of formula (XVIII) or (XIX) are given below without any intention of limitation.

B-1
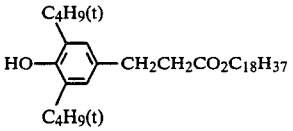
B-2
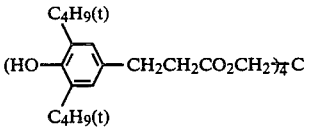
B-3
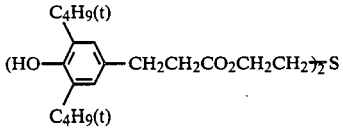
B-4
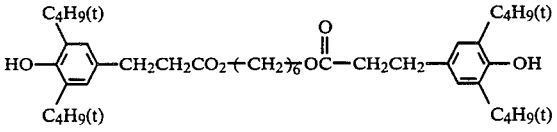
B-5
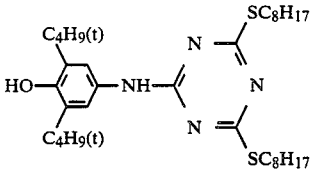
B-6
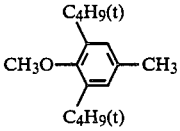
B-7
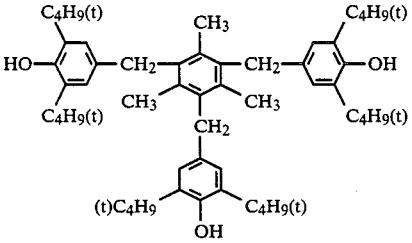
B-8
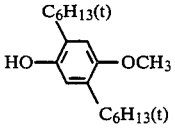
B-9
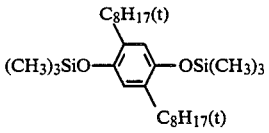
B-10
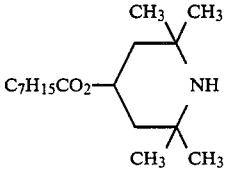
-continued
B-11
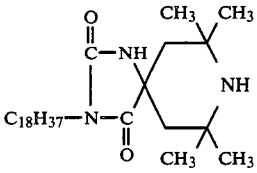
B-12
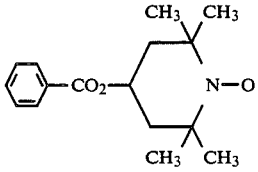
B-13
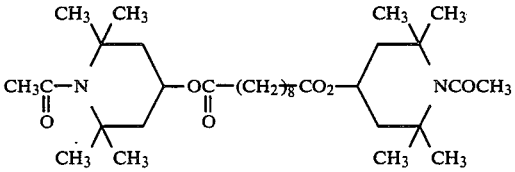
B-14
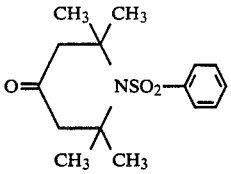
B-15
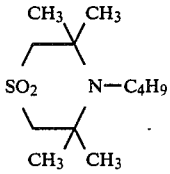
B-16
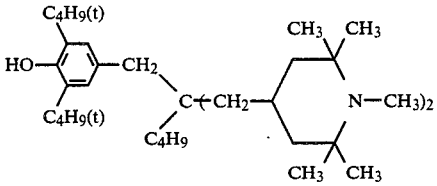
B-17
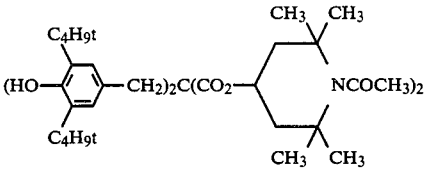
B-18
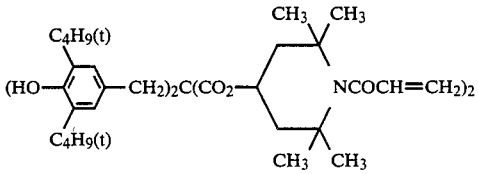

-continued

B-19

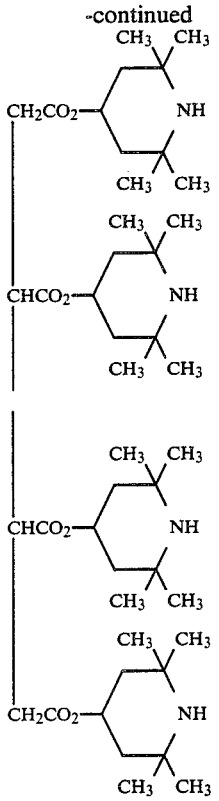

B-20

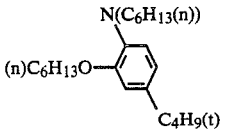

B-21

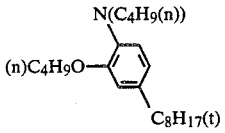

The methods of synthesizing the compounds corresponding to formula (XVIII) or (XIX) or examples of other compounds corresponding to these formulae are described in British Patents 1,326,889, 1,354,313 and 1,410,846, U.S. Patents 3,336,135 and 4,268,593, Japanese Patent Publication Nos. 1420/76 and 6623/77 and Japanese Patent Application (OPI) Nos. 114036/83 and 5246/84.

Two or more compounds of formulae (XVIII) and (XIX) may be used in combination with each other or with previously known anti-fading agents.

The amount of the compound of formula (XVIII) or (XIX) differs depending upon the type of the yellow coupler to be used in combination with it. Generally, the desired purpose can be achieved by using it in an amount of 0.5 to 200% by weight, preferably 2 to 150% by weight, based on the yellow coupler. Preferably, this compound is emulsified together with the yellow coupler of formula (IV).

The aforesaid various dye image stabilizers, stain preventing agents or antioxidants are also effective in improving the preservability of magenta dye images produced by the couplers of formula (II) or (III) or from (V) to (IX). Groups of compounds represented by the following formulae (XX), (XXI), (XXII), (XXIII), (XXIV) and (XXV) are especially preferred because they greatly improve the light fastness of the aforesaid magenta dye images.

(XX)

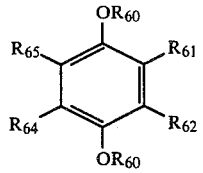

(XXI)

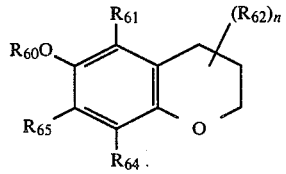

(XXII)

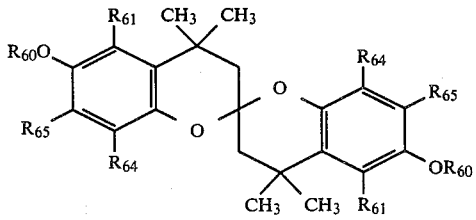

(XXIII)

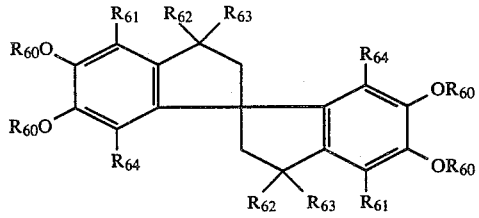

(XXIV)

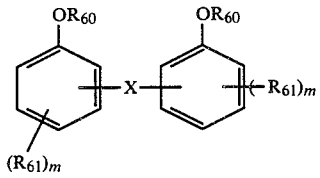

(XXV)

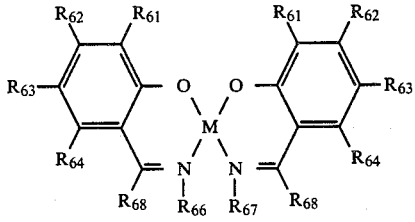

In formulae (XX) to (XXV), $R_{60}$ is the same as $R_{40}$ in formula (XVIII); $R_{61}$, $R_{62}$, $R_{63}$, $R_{64}$ and $R_{65}$ may be identical or different and each represents a hydrogen atom, an aliphatic group, an aromatic group, an acylamino group, a mono- or dialkylamino group, an aliphatic or aromatic thio group, an acylamino group, an aliphatic or aromatic oxycarbonyl group, or the group —$OR_{40}$; $R_{40}$ and $R_{61}$may be bonded to each other to form a 5- or 6-membered ring; $R_{61}$ and $R_{62}$ together may form a 5- or 6-membered ring; $R_{66}$ and $R_{67}$ may be identical or different and each represents a hydrogen atom, an aliphatic group, an aromatic group or a hydroxyl group; $R_{68}$ represents a hydrogen atom, an aliphatic group or an aromatic group; $R_{66}$ and $R_{67}$ may together form a 5- or 6-membered ring; M represents Cu, Co, Ni, Pd or Pt; when the substituents $R_{61}$ to $R_{68}$ are aliphatic or aromatic groups, they may be substituted by the substituents described for $R_1$; and n represents an integer of from 0 to 6 and m represents an integer of from 0 to 4, and n and m indicate the number of the groups $R_{62}$ and $R_{61}$, respectively, and when they are 2 or more, the substituents $R_{62}$ or the substituents $R_{61}$ may be identical or different.

In formula (XXIV), preferred typical examples of X are

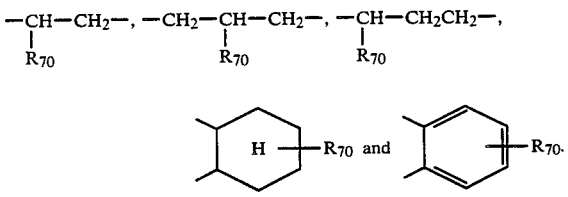

$R_{70}$ herein represents a hydrogen atom or an alkyl group.

In formula (XXV), $R_{61}$ is preferably a group capable of being attached by hydrogen bonding. Compounds of formula (XXV) in which at least one of $R_{62}$, $R_{63}$ and $R_{64}$ is a hydrogen atom, a hydroxyl group, an alkyl group or an alkoxy group are preferred. Each of the substituents $R_{61}$ to $R_{68}$ preferably contains not more than 4 carbon atoms in total.

Specific examples of the compounds of formulae (XX) to (XXV) are given below without any intention of limitation.

G-1

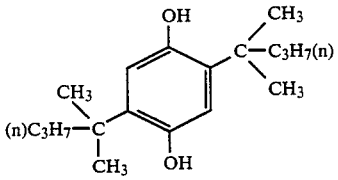

G-2

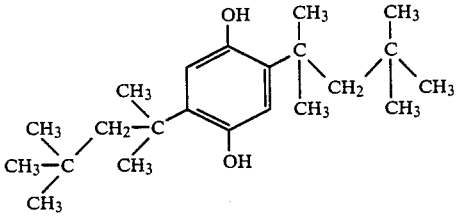

G-3

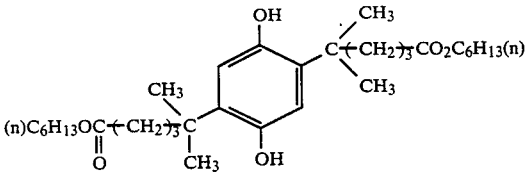

G-4

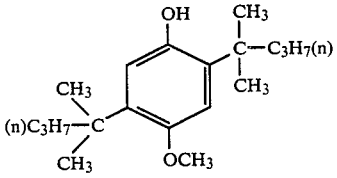

-continued

G-5

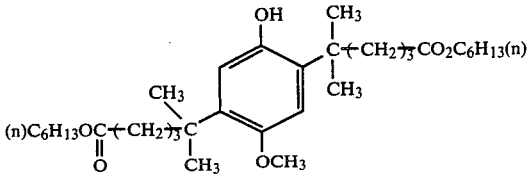

G-6

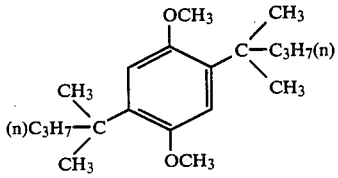

G-7

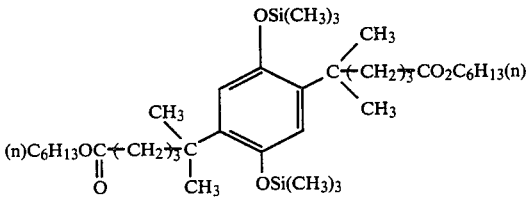

G-8

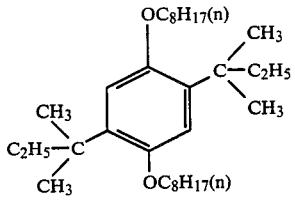

G-9

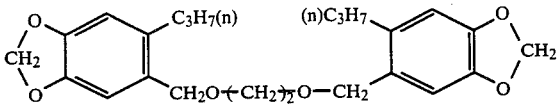

G-10

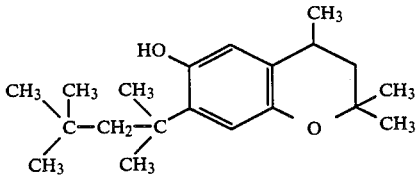

G-11

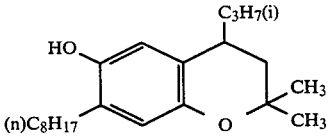

G-12

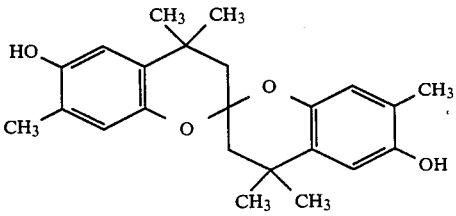

-continued

G-13

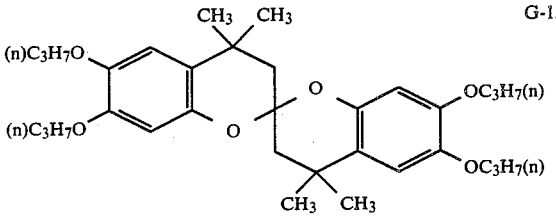

G-14

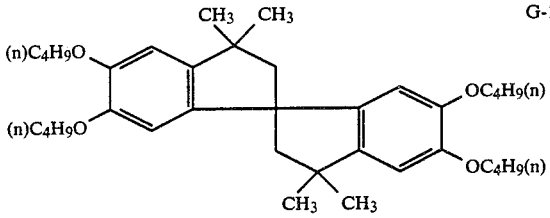

G-15

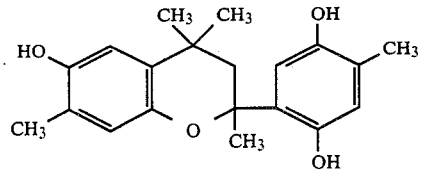

G-16

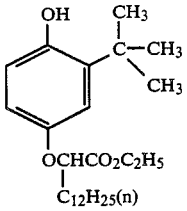

G-17

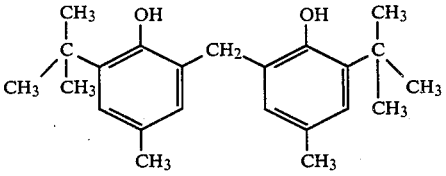

G-18

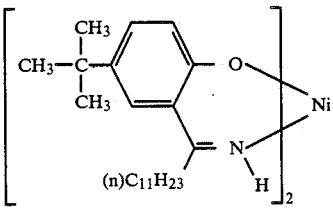

G-19

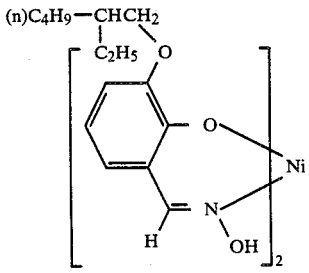

-continued

G-20

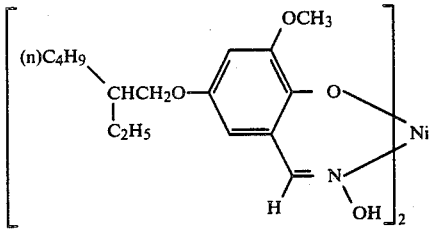

G-21

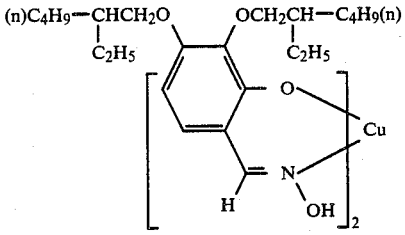

G-22

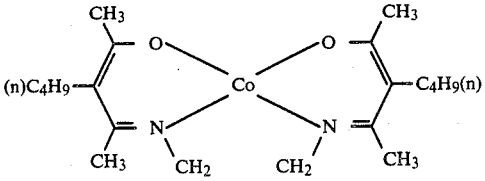

G-23

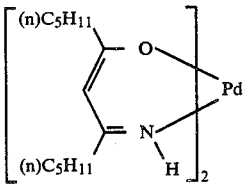

The methods of synthesizing these compounds and examples of other compounds within the above formulae are described in U.S. Pat. Nos. 3,336,135, 3,432,300, 3,573,050, 3,574,627, 3,700,455, 3,764,337, 3,935,016, 3,982,944, 4,254,216 and 4,279,990, British Pat. Nos. 1,347,556, 2,062,888, 2,066,975 and 2,077,455, Japanese Patent Application No. 205278/83, Japanese Patent Application (OPI) Nos. 152225/77, 17729/78, 20327/78, 145530/79, 6321/80, 21004/80, 24141/83 and 10539/84 and Japanese Patent Publication Nos. 31625/73 and 12337/79.

Of the anti-fading agents used in this invention, the compounds of formulae (XX) to (XXIV) are added in an amount of 10 to 200 mole%, preferably 30 to 100 mole%, based on the magenta coupler in accordance with this invention. On the other hand, the compound of formula (XXV) is added in an amount of 1 to 100 mole%, preferably 5 to 40 mole%, based on the magenta coupler. Preferably, these compounds are emulsified together with the magenta couplers.

For preventing fading, Japanese Patent Application (OPI) Nos. 11330/74 and 57223/75 disclose techniques of enclosing a dye image with an oxygen-shielding layer composed of a substance having a low oxygen permeability, and Japanese Patent Application (OPI) No. 85747/81 discloses the provision of a layer having an oxygen permeability of not more than 20 ml/m$^2$.hr.atm. on the support side of a color image forming layer of a color photographic light-sensitive material. These techniques can also be applied to the present invention.

Various silver halides can be used in the silver halide emulsion layers used in this invention. Examples are silver chloride, silver bromide, silver chlorobromide, silver iodobromide and silver chloroiodobromide. Silver iodobromide containing 2 to 20 mole% of silver iodide and silver chlorobromide containing 10 to 50 mole% of silver bromide are preferred. There is no limitation on the crystal form, crystal structure, grain size, grain size distribution, etc., of the silver halide grains. The crystals of silver halide may be normal or twinning, and may be hexagonal, octagonal or tetradecagonal. Or they may be tabular grains having a thickness of 0.5 micron or less, a diameter of at least 0.6 micron and an average aspect ratio of at least 5 as described in *Research Disclosure,* 22534.

The crystal structure may be uniform or have a difference in composition between the interior and the outside portions. It may be a layered structure or contain silver halides of different compositions bonded by epitaxial bonding. Alternatively, it may comprise a mixture of grains having various crystal forms. The silver halide crystals may also permit formation of latent images mainly on the surface of the grains or in the inside of the grains.

The grain diameter of the silver halide may be not more than 0.1 micron, or they may be large sized grains with a projection area diameter of up to 3 microns. They may be monodisperse emulsions having a narrow size distribution, or polydisperse emulsions having a broad size distribution.

These silver halide grains can be produced by known methods customarily used in the art.

The silver halide emulsions can be sensitized by ordinary chemical sensitization methods using sulfur and noble metals either singly or in combination. The silver halide emulsions in this invention may also be sensitized to the desired light-sensitive wavelength regions by using sensitizing dyes. Dyes which can be advantageously used in this invention include methine dyes such as cyanines, hemicyanines, rhodacyanines, merocyanines, oxonols, and hemioxonols, and styryl dyes. They may be used singly or in combination.

A transparent support such as polyethylene terephthalate or cellulose triacetate and a reflective support to be described below may be used in the present invention. The reflective support is preferred. Examples of the support include baryta paper, polyethylene-coated paper, polypropylene type synthetic paper-like sheets, and transparent supports having a reflective layer or a reflective material such as a glass sheet, polyester films such as polyethylene terephthalate, cellulose triacetate or cellulose nitrate films, polyamide films, polycarbonate films and polystyrene films. These supports may be properly selected according to the intended uses.

The blue-sensitive, green-sensitive and red-sensitive emulsions used in this invention are spectrally sensitized to the respective colors with methine and other dyes. Useful sensitizing dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are those belonging to cyanine dyes, merocyanine dyes and complex merocyanine dyes. These dyes may contain basic heterocyclic nuclei usually utilized in cyanine dyes, for example, pyrroline, oxazoline, thiazoline, pyrrole, oxazole, thiazole, selenazole, imidazole, tetrazole and pyridine nuclei; nuclei resulting from fusing of alicyclic hydrocarbon rings to these nuclei; and nuclei resulting from fusing of aromatic hydrocarbon rings to these nuclei, such as indolenine, benzindolenine, indole, benzoxazole, naphthoxazole, benzothiazole, naphthothiazole, benzoselenazole, benzimidazole and quinoline nuclei. These nuclei may be substituted on carbon atoms.

The merocyanine dyes or complex merocyanine dyes may include 5- or 6-membered heterocyclic nuclei, such as pyrazolin-5-one, thiohydantoin, 2-thioxazolidin-2,4-dione, thiazolidin-2,4-dione, rhodanine and thiobarbituric acid nuclei, as nuclei having a ketomethylene structure.

These sensitizing dyes may be used singly or in combination. Combinations of sensitizing dyes are frequently used for the purpose of supersensitization. Typical examples are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

The emulsions may contain, in addition to the sensitizing dyes, dyes which do not have spectral sensitizing action by themselves or substances which do not substantially absorb visible light and show supersensitizing activity.

The color photographic light-sensitive material of this invention may further contain auxiliary layers such as a subbing layer, an interlayer and a protective layer in addition to the main layers described above. As required, a second ultraviolet light absorbing layer may be provided between the red-sensitive silver halide emulsion layer and the green-sensitive silver halide emulsion layer. The ultraviolet light absorbers described hereinabove are preferably used in the second ultraviolet light absorbing layer, but other known ultraviolet light absorbers may also be used.

Advantageously, gelatin is used as a binder or protective colloid for the photographic emulsions. Other hydrophilic colloids may also be used. For example, there can be used various synthetic hydrophilic high molecular weight materials, for example, proteins such as gelatin derivatives, graft polymers of gelatin with other polymers, albumin and casein; cellulose derivatives such as hydroxyethyl cellulose, carboxymethyl cellulose and cellulose sulfate; carbohydrate derivatives such as sodium alginate and starch derivatives, and mono- and copolymers such as polyvinyl alcohol, a partial acetal of polyvinyl alcohol, poly-N-vinylpyrrolidone, polyacrylic acid, polymethacrylic acid, polyacrylamide, polyvinyl imidazole and polyvinyl pyrazole.

Lime-treated gelatin, acid-treated gelatin and enzyme-treated gelatin which is described in *Bull. Soc. Sci. Phot., Japan,* No. 16, page 30 (1966) may be used as the gelatin. A hydrolysis product or enzymatically decomposed product of gelatin may also be used.

In the photographic material of this invention, the photographic emulsion layers and other hydrophilic colloid layers may contain bleaching agents of the stilbene, triazine, oxazole or coumarin type. They may be water-soluble bleaching agents. Alternatively, water-insoluble bleaching agents may be used in the form of a dispersion. Specific examples of fluorescent bleaching agents are described, for example, in U.S. Pat. Nos. 2,632,701, 3,269,840 and 3,359,102, British Patents 852,075 and 1,319,763, and the description of brighteners at page 24, left-hand column, lines 9–36 of *Research*

*Disclosure,* Vol. 176, 17643 (published in December 1978).

When the hydrophilic colloid layer of the photographic material of this invention contains a dye, an ultraviolet light absorber, etc., they may be mordanted by a cationic polymer, etc. For example, there can be used the polymers described in British Pat. No. 685,475, U.S. Pat. Nos. 2,675,316, 2,839,401, 2,882,156, 3,048,487, 3,184,309 and 3,445,231, West German Patent Application (OLS) No. 1,914,362, and Japanese Patent Application (OPI) Nos. 47624/75 and 71332/75.

The photographic material of this invention may contain hydroquinone derivatives, aminophenol derivatives, gallic acid derivatives, ascorbic acid derivatives, etc., as color antifogging agents. Specific examples thereof are described, for example, in U.S. Pat. Nos. 2,360,290, 2,336,327, 2,403,721, 2,418,613, 2,675,314, 2,701,197, 2,704,713, 2,728,659, 2,732,300 and 2,735,765, Japanese Patent Application (OPI) Nos. 92988/75, 92989/75, 93928/75, 110337/75 and 146235/77, and Japanese Patent Publication No. 23813/75.

As required, other various photographic additives known in the art, such as stabilizers, anti-foggants, surface active agents, couplers other than those of this invention, filter dyes, irradiation preventing dyes, and developing agents, can be added to the color photographic light-sensitive material of this invention.

As required, substantially non-photosensitive silver halide emulsions in fine grains (for example, silver chloride, silver bromide and silver chlorobromide emulsions having an average grain size of not more than 0.20 micron) may be added to the silver halide emulsion layers or the other hydrophilic colloid layer.

A preferred color developer which can be used in this invention is an alkaline aqueous solution containing an aromatic primary amine color developing agent as a main component. Typical examples of the color developing agent include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline.

The color developer may contain pH buffers such as alkali metal sulfites, carbonates, borates and phosphates, and development inhibitors or antifoggants such as bromides, iodides, and organic antifoggants. As required, it may further contain water-softening agents, preservatives such as hydroxylamine, organic solvents such as benzyl alcohol and diethylene glycol, development accelerators such as polyethylene glycol, quaternary ammonium salts and amines, dye forming couplers, competitive couplers, foggants such as sodium borohydride, auxiliary developers such as 1-phenyl-3-pyrazolidone, viscosity imparting agents, the polycarboxylic acid type chelating agents described in U.S. Pat. No. 4,083,723, and the antioxidants described in West German Patent Application (OLS) No. 2,622,950.

Usually, the photographic emulsion layers after color development are subjected to a bleaching treatment. The bleaching treatment may be carried out at the same time as fixation, or separately. Examples of bleaching agents include compounds of polyvalent metals such as iron (III), cobalt (III), chromium (VI) and copper (II), peracids, quinones and nitroso compounds. For example, there can be used ferricyanides, bichromate salts, organic complex salts of iron (III) or cobalt (III), complex salts or organic acids such as ethylenediaminetetraacetic acid, nitrilotriacetic acid, aminopolycarboxylic acids (e.g., 1,3-diamino-2-propanoltetraacetic acid), citric acid, tartaric acid and malic acid, persulfates, permanganates, and nitrosophenol. Of these, potassium ferricyanide, sodium iron (III) ethylenediaminetetraacetate and ammonium iron (III) ethylenediaminetetraacetate are especially useful. Iron (III) complex salts of ethylenediaminetetraacetic acid are useful both in an independent bleaching solution and in a monobath bleaching-fixing solution.

After color development or the bleaching fixing treatment, the photographic material may be washed with water. The color development may be carried out at any temperature between 18° C. and 55° C., preferably at least 30° C., especially preferably at least 35° C. The time required for the development is about 3.5 minutes to about 1 minute and is preferably shorter. In continuous development, the solution is preferably replenished. Per $m^2$ of a processed area, 330 to 160 cc, preferably not more than 100 cc, of the solution is additionally supplied. Preferalby, the concentration of benzyl alcohol in the developer solution is not more than 5 ml/liter.

Bleaching-fixation can be carried out at any desired temperature between 18° and 50° C., preferably at least 30° C. If the temperature is set at 35° C. or higher, the treating time can be shortened to 1 minute or less, and the amount of the solution to be additionally supplied can be decreased. The time required for washing after color development or bleaching-fixation is usually within 3 minutes, and washing can be performed within 1 minute using a stabilization bath.

The resulting dyes are susceptible to degradation by light, heat or moisture, and also by molds during storage. The cyan image is especially susceptible to degradation by molds, and the use of moldproofing agents is preferred. The 2-thiazolyl benzimidazoles described in Japanese Patent Application (OPI) No. 157244/82 are specific examples of the moldproofing agents. The mold-proofing agent may be incorporated in the photographic material or added externally in the step of development. It may be added at any desired stage if it is present in the processed photographic material.

The following non-limiting Examples illustrate the present invention in greater detail.

Unless otherwise indicated, all parts, percents, etc., are by weight.

EXAMPLE 1

The first layer (lowermost layer) to the seventh layer (uppermost layer) indicated in Table I were coated on paper having polyethylene laminated to both surfaces to prepare color photographic light-sensitive materials (Samples A to M).

The coating solution for the first layer was prepared as follows: 100 g of the yellow coupler indicated in Table I was dissolved in a mixture of 166.7 ml of dibutyl phthalate (DBP) and 200 ml of ethyl acetate. The solution was emulsified and dispersed in 800 g of a 10% aqueous solution containing 80 ml of a 1% aqueous solution of sodium dodecylbenzenesulfonate. The dispersion was mixed with 1,450 g (66.7 g as Ag) of a blue-sensitive silver chlorobromide (Br 80%) to prepare the coating solution.

The coating solutions for the other layers were prepared in the same way as above.

As a hardener for each of the layers, the sodium salt of 2,4-dichloro-6-hydroxy-s-triazine was used.

The following spectral sensitizing agents were used for the emulsions.

Blue-Sensitive Emulsion Layer

Sodium salt of 3,3'-di(γ-sulfopropyl)selenacyanine ($2\times10^{-4}$ mole per mole of silver halide)

Green-Sensitive Emulsion Layer

Sodium salt of 3,3'-di(γ-sulfopropyl)-5,5'-diphenyl-9-ethyloxacarbocyanine ($2.5\times10^{-4}$ mole per mole of silver halide)

Red-Sensitive Emulsion Layer

Sodium salt of 3,3'-di(γ-sulfopropyl)-9-methylthiadicarbocyanine ($2.5\times10^{-4}$ mole per mole of silver halide)

The following irradiation preventing dyes were used for the emulsion layers.

Green-Sensitive Emulsion Layer

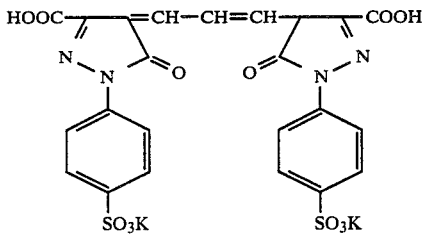

Red-Sensitive Emulsion Layer

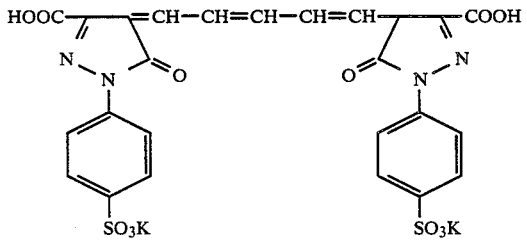

In Table I, TOP stands for tri(n-octyl phosphate), and the compounds a to i have the following chemical structures.

a:

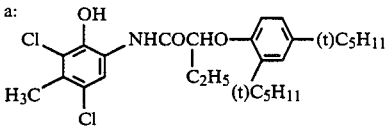

cyan coupler for comparison b:

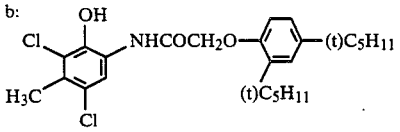

cyan coupler for comparison c:

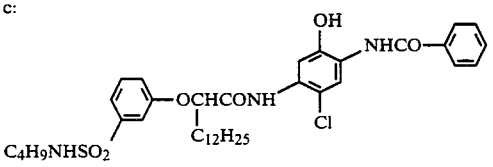

cyan coupler for comparison

-continued d:

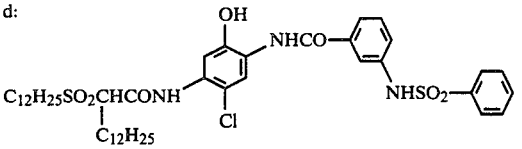

cyan coupler for comparison e:

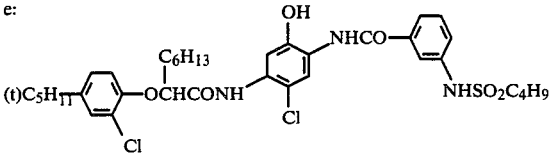

cyan coupler for comparison f:

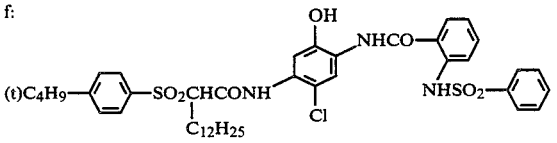

cyan coupler for comparison g: Compound G-1 given hereinabove
h: Compound G-14 given hereinabove
i: Compound B-18 given hereinabove Each of the above samples was gradation exposed by an enlarging machine (Fuji Color Head 690, a product of Fuji Photo Film Co., Ltd.), and then subjected to the following development.

| | |
|---|---|
| Developer | |
| Trisodium nitrilotriacetate | 2.0 g |
| Benzyl alcohol | 15 ml |
| Diethylene glycol | 10 ml |
| $Na_2SO_3$ | 2.0 g |
| KBr | 0.5 g |
| Hydroxylamine sulfate | 3.0 g |
| 4-Amino-3-methyl-N—ethyl-N—[β-(methanesulfonamido)ethyl]-p-phenylenediamine sulfate | 5.0 g |
| $Na_2CO_3$ (monohydrate) | 30 g |
| Water to make 1 liter (pH 10.1) | |
| Bleaching-Fixing Bath | |
| Ammonium thiosulfate (70 wt %) | 150 ml |
| $Na_2SO_3$ | 15 g |
| $NH_4$ [Fe(EDTA)] | 55 g |
| EDTA.2Na | 4 g |
| Water to make 1 liter (pH 6.9) | |

| Processing Steps | Temperature (°C.) | Time (minutes) |
|---|---|---|
| Developer | 33 | 3.5 |
| Bleaching-fixing solution | 33 | 1.5 |
| Washing with water | 28–35 | 3 |
| Drying | | |

Each of the samples so processed was subjected to a fading test involving direct exposure to sunlight. The yellow, magenta and cyan densities of the samples were measured by a Macbeth densitometer (Model RD-514) with blue light, green light and red light. Table II summarizes the densities of the samples (initial density = 1.0) after exposure for 2 hours, 6 hours, 4 weeks and 8 weeks, respectively. The measurement of fading after exposure for 2 or 6 hours was made immediately after exposure. The measurement of fading after exposure for 4 or 8 weeks was carried out after leaving the samples for 1 day in the dark when the vanished color was reversibly returned to the original color. The results are shown in Table II.

The following conclusions can be drawn from Table II.

The samples for comparison abruptly decrease in cyan density upon exposure to sunlight for several hours, while scarcely any change occurs in the yellow and magenta densities. Hence, the color balance is destroyed, and the color becomes reddish.

The samples exposed to sunlight for a long period of time decrease in cyan density to a greater extent than in yellow and magenta densities, and the color becomes reddish.

In contrast, the samples of this invention decrease little in cyan density upon exposure for short to long periods of time and maintain a balance among the three colros, yellow, magenta and cyan. They show a fading behavior not significantly perceptible visually.

Furthermore, the yellow, magenta and cyan dye images of Samples G to M of the invention hardly change at high temperatures and humidities and are very stable.

TABLE I

| | Sample No. | | | | | | | | | | | | |
|---|---|---|---|---|---|---|---|---|---|---|---|---|---|
| | Comparison | | | | | | Invention | | | | | | |
| | A | B | C | D | E | F | G | H | I | J | K | L | M |
| 7th layer (protective layer) | | | | | | | | | | | | | |
| Amount of gelatin coated | 1500 mg/$m^2$ | " | " | " | " | " | " | " | " | " | " | " | " |
| 6th layer (ultraviolet light absorbing layer) | | | | | | | | | | | | | |
| Amount of gelatin coated | 1500 mg/$m^2$ | " | " | " | " | " | " | " | " | " | " | " | " |
| Types of ultraviolet light absorbers | UV-3/UV-1/UV-4 | " | " | " | " | " | " | " | " | " | " | " | UV-3/UV-4/UV-16 |
| Amounts of the ultraviolet light absorbers coated | 50/150/300 mg/$m^2$ | " | " | " | " | " | " | " | " | " | " | " | 50/150/400 mg/$m^2$ |
| Type of a solvent for the ultraviolet light absorber | DBP | " | " | " | " | " | " | " | " | " | " | " | " |
| Amount of the solvent coated | 200 mg/$m^2$ | " | " | " | " | " | " | " | " | " | " | " | " |
| 5th layer (red-sensitive layer) | | | | | | | | | | | | | |
| Amount of Ag in silver chlorobromide emulsion (Br 50%) | 300 mg/$m^2$ | " | " | " | " | " | " | " | " | " | " | " | " |
| Type of cyan coupler | a | a/b | c | d | e | f | c-1 | c-1/a | c-7 | c-1 | c-6 | c-9 | c-1 |
| Amount of the cyan coupler coated | 400 mg/$m^2$ | 200/200 mg/$m^2$ | 400 mg/$m^2$ | " | " | " | " | 250/150 mg/$m^2$ | 400 mg/$m^2$ | " | " | " | " |
| Type of a solvent for the cyan coupler | DBP | " | " | " | " | " | " | " | " | " | " | " | " |
| Amount of the solvent coated | 240 mg/$m^2$ | " | " | " | " | " | " | " | " | " | " | " | " |
| Ultraviolet light absorber | — | UV-3/UV-1/UV-4 | — | — | — | — | — | — | — | — | — | UV-3/UV-1/UV-4 | " |
| | — | 20/50/60 mg/$m^2$ | — | — | — | — | — | — | — | — | — | 20/50/60 mg/$m^2$ | " |
| 4th layer (ultraviolet light absorbing layer) | | | | | | | | | | | | | |
| Amount of gelatin coated | 2000 mg/$m^2$ | " | " | " | " | " | " | " | " | " | " | " | " |
| Types of ultraviolet light absorbers | UV-3/UV-1/UV-4 | " | " | " | " | " | " | " | " | " | " | " | UV-3/UV-4/UV-16 |
| Amounts of the ultraviolet light absorber coated | 15/45/90 mg/$m^2$ | " | " | " | " | " | " | " | " | " | " | " | 15/45/140 mg/$m^2$ |
| Type of a solvent for the ultraviolet light absorbers | DBP | " | " | " | " | " | " | " | " | " | " | " | " |
| Amount of the solvent coated | 60 mg/$m^2$ | " | " | " | " | " | " | " | " | " | " | " | " |
| 3rd layer (green-sensitive layer) | | | | | | | | | | | | | |
| Amount of Ag of a silver chlorobromide emulsion (Br 70%) | 450 mg/$m^2$ | " | " | " | " | " | " | " | " | 200 mg/$m^2$ | " | " | " |
| Type of a magenta coupler coated | M-18 | " | " | " | " | " | " | " | " | M-15 | " | " | " |
| Amount of the magenta coupler coated | 350 mg/$m^2$ | " | " | " | " | " | " | " | " | 300 mg/$m^2$ | " | " | " |

TABLE I-continued

| | Sample No. | | | | | | | | | | | |
|---|---|---|---|---|---|---|---|---|---|---|---|---|
| | Comparison | | | | | | Invention | | | | | |
| | A | B | C | D | E | F | G | H | I | J | K | L | M |
| Type of a solvent for the magenta coupler | TOP | " | " | " | " | " | " | " | " | " | " | " | " |
| Amount of the solvent coated | 440 mg/$m^2$ | " | " | " | " | " | " | " | " | 400 mg/$m^2$ | " | " | " |
| Type of an anti-fading agent | g/h | " | " | " | " | " | " | " | " | " | " | " | " |
| Amount of the anti-fading agent coated | 50/100 mg/$m^2$ | " | " | " | " | " | " | " | " | " | " | " | " |
| 2nd layer (color mixing preventing layer) | | | | | | | | | | | | | |
| Amount of gelatin coated | 1500 mg/$m^2$ | " | " | " | " | " | " | " | " | " | " | " | " |
| 1st layer (blue-sensitive layer) | | | | | | | | | | | | | |
| Amount of Ag in a silver chlorobromide (Br 80%) | 400 mg/$m^2$ | " | " | " | " | " | " | " | " | " | " | " | " |
| Type of a yellow coupler | Y-36 | " | " | " | " | " | " | " | " | " | Y-35 | Y-10 | Y-35 |
| Amount of the yellow Coupler coated | 600 mg/$m^2$ | " | " | " | " | " | " | " | " | " | 650 mg/$m^2$ | 600 mg/$m^2$ | 650 mg/$m^2$ |
| Type of a solvent for the yellow coupler | DBP | " | " | " | " | " | " | " | " | " | TOP | " | " |
| Amount of the solvent coated | 1000 mg/$m^2$ | " | " | " | " | " | " | " | " | " | " | " | " |
| Type of an antifading agent | i | " | " | " | " | " | " | " | " | " | " | " | " |
| Amount of the anti-fading agent coated | 100 mg/$m^2$ | " | " | " | " | " | " | " | " | " | " | " | " |

*The mark " in the above table means that it is the same as the left.

TABLE II

| Sample No. | Remark | Fading under Sunlight, 2 Hours | | | Fading under Sunlight, 6 Hours | | | Fading under Sunlight, 4 Weeks | | | Fading under Sunlight, 8 Weeks | | |
|---|---|---|---|---|---|---|---|---|---|---|---|---|---|
| | | $D_B$ | $D_G$ | $D_R$ | $D_B$ | $D_G$ | $D_R$ | $D_B$ | $D_G$ | $D_R$ | $D_B$ | $D_G$ | $D_R$ |
| A | Comparison | 1.00 | 0.99 | 0.92 | 1.00 | 0.99 | 0.88 | 0.93 | 0.90 | 0.85 | 0.83 | 0.82 | 0.73 |
| B | " | 1.00 | 1.00 | 0.90 | 0.99 | 1.00 | 0.86 | 0.94 | 0.91 | 0.82 | 0.82 | 0.81 | 0.71 |
| C | " | 1.00 | 1.00 | 0.91 | 1.00 | 1.00 | 0.89 | 0.93 | 0.90 | 0.83 | 0.83 | 0.83 | 0.70 |
| D | " | 1.00 | 0.99 | 0.90 | 1.00 | 0.99 | 0.87 | 0.92 | 0.91 | 0.85 | 0.83 | 0.82 | 0.71 |
| E | " | 1.00 | 1.00 | 0.92 | 0.99 | 1.00 | 0.88 | 0.94 | 0.90 | 0.81 | 0.82 | 0.81 | 0.70 |
| F | " | 1.00 | 1.00 | 0.92 | 1.00 | 1.00 | 0.89 | 0.94 | 0.92 | 0.83 | 0.81 | 0.82 | 0.69 |
| G | Invention | 1.00 | 1.00 | 0.99 | 1.00 | 0.99 | 0.97 | 0.94 | 0.93 | 0.92 | 0.82 | 0.82 | 0.82 |
| H | " | 0.99 | 1.00 | 0.97 | 0.99 | 1.00 | 0.95 | 0.93 | 0.92 | 0.89 | 0.83 | 0.81 | 0.79 |
| I | " | 1.00 | 0.99 | 0.98 | 1.00 | 0.99 | 0.98 | 0.94 | 0.91 | 0.90 | 0.81 | 0.83 | 0.84 |
| J | " | 1.00 | 1.00 | 0.99 | 1.00 | 0.99 | 0.98 | 0.93 | 0.91 | 0.91 | 0.84 | 0.82 | 0.82 |
| K | " | 0.99 | 1.00 | 0.99 | 0.99 | 1.00 | 0.98 | 0.93 | 0.92 | 0.91 | 0.83 | 0.81 | 0.81 |
| L | " | 1.00 | 1.00 | 0.99 | 1.00 | 1.00 | 0.98 | 0.94 | 0.91 | 0.90 | 0.82 | 0.80 | 0.80 |
| M | " | 1.00 | 0.99 | 0.98 | 1.00 | 0.99 | 0.98 | 0.96 | 0.95 | 0.91 | 0.82 | 0.88 | 0.81 |

($D_B$, $D_G$ and $D_R$ respectively represents the densities of yellow, magenta and cyan.)

EXAMPLE 2

The first layer (lowermost layer) to the seventh layer (uppermost layer) indicated in Table III were coated on paper having polyethylene laminated to both surfaces to prepare color photographic light-sensitive materials (Samples A-1 to M-1).

The preparation of the respective layers, spectral sensitizer, irradiating preventing agent, and the chemical structures of compounds a to f, h, and i are the same as in Example 1.

The thus prepared respective samples were subjected to the exposure to light and photographic processing in the same manner as in Example 1.

Each of the samples so processed was subjected to a fading test involving direct exposure to sunlight. The yellow, magenta and cyan densities of the samples were measured by a Macbeth densitometer (Model RD-514) with blue light, green light and red light. Table IV summarizes the densities of the samples (initial density = 1.0) after exposure for 2 hours, 6 hours, 4 weeks and 8 weeks, respectively. The measurement of fading after exposure for 2 or 6 hours was made immediately after exposure. The measurement of fading after exposure for 4 or 8 weeks was carried out after leaving the samples for 1 day in the dark when the vanished color was reversibly returned to the original color. The results are shown in Table IV.

The following conclusions can be drawn from Table IV.

The samples for comparison abruptly decrease in cyan density upon exposure to sunlight for several hours, while scarcely any change occurs in the yellow and magenta densities. Hence, the color balance is destroyed, and the color becomes reddish.

The samples exposed to sunlight for a long period of time decrease in cyan density to a greater extent than in yellow and magenta densities, and the color becomes reddish.

In contrast, the samples of this invention decrease little in cyan density upon exposure for short to long periods of time and maintain a balance among the three colors, yellow, magenta and cyan. They show a fading behavior not significantly perceptible visually.

Furthermore, the yellow, magenta and cyan dye images of Samples G-1 to M-1 of the invention hardly change at high temperatures and humidities and are very stable.

TABLE III

| | Sample No. | | | | | | | | | | | | |
|---|---|---|---|---|---|---|---|---|---|---|---|---|---|
| | Comparison | | | | | | Invention | | | | | | |
| | A-1 | B-1 | C-1 | D-1 | E-1 | F-1 | G-1 | H-1 | I-1 | J-1 | K-1 | L-1 | M-1 |
| 7th layer (protective layer) | | | | | | | | | | | | | |
| Amount of gelatin coated | 1500 mg/$m^2$ | " | " | " | " | " | " | " | " | " | " | " | " |
| 6th layer (ultaviolet light absorbing layer) | | | | | | | | | | | | | |
| Amount of gelatin coated | 1500 mg/$m^2$ | " | " | " | " | " | " | " | " | " | " | " | " |
| Type of ultraviolet light absorbers | UV-3/ UV-1/ UV-4 | " | " | " | " | " | " | " | " | " | " | " | UV-3/ UV-4/ UV-16 |
| Amounts of the ultra-violet light absorbers coated | 50/150/ 300 mg/$m^2$ | " | " | " | " | " | " | " | " | " | " | " | 50/150/ 400 mg/$m^2$ |
| Type of a solvent for the ultraviolet light absorber | DBP | " | " | " | " | " | " | " | " | " | " | " | " |
| Amount of the solvent coated | 200 gm/$m^2$ | " | " | " | " | " | " | " | " | " | " | " | " |
| 5th layer (red-sensitive layer) | | | | | | | | | | | | | |
| Amount of Ag in silver chlorobromide emulsion (Br 50%) | 300 mg/$m^2$ | " | " | " | " | " | " | " | " | " | " | " | " |
| Type of cyan coupler | a | a/b | c | d | e | f | c-1 | c-1/a | c-7 | c-1 | c-6 | c-9 | c-1 |
| Amount of the cyan coupler coated | 400 mg/$m^2$ | 200/ 200 mg/$m^2$ | 400 mg/$m^2$ | " | " | " | " | 250/ 150 mg/$m^2$ | 400 mg/$m^2$ | " | " | " | " |
| Type of a solvent for the cyan coupler | DBP | " | " | " | " | " | " | " | " | " | " | " | " |
| Amount of the solvent coated | 240 mg/$m^2$ | " | " | " | " | " | " | " | " | " | " | " | " |
| Ultraviolet light absorber | — | UV-3/ UV-1/ UV-4 | — | — | — | — | — | — | — | — | — | UV-3/ UV-1/ UV-4 | " |
| | — | 20/50/ 60 mg/$m^2$ | — | — | — | — | — | — | — | — | — | 20/50/ 60/mg/$m^2$ | " |
| 4th layer (ultraviolet light absorbing layer) | | | | | | | | | | | | | |
| Amount of gelatin coated | 200 mg/$m^2$ | " | " | " | " | " | " | " | " | " | " | " | " |
| Types of ultraviolet light absorbers | UV-3/ UV-1/ UV-4 | " | " | " | " | " | " | " | " | " | " | " | UV-3/ UV-4/ UV-16 |
| Amount of the ultra-violet light absorbers coated | 15/45/ 90 mg/$m^2$ | " | " | " | " | " | " | " | " | " | " | " | 15/45/ 140 mg/$m^2$ |
| Type of a solvent for the ultraviolet light absorbers | DBP | " | " | " | " | " | " | " | " | " | " | " | " |
| Amount of the solvent coated | 60 mg/$m^2$ | " | " | " | " | " | " | " | " | " | " | " | " |
| 3rd layer (green-sensitive layer) | | | | | | | | | | | | | |
| Amount of Ag of a silver chlorobromide emulsion (Br 70%) | 200 mg/$m^2$ | " | " | " | " | " | " | " | " | 200 mg/$m^2$ | " | " | " |
| Type of a magenta coupler coated | M-40 | " | " | " | " | " | " | " | " | M-49 | " | " | " |
| Amount of the magenta coupler coated | 350 mg/$m^2$ | " | " | " | " | " | " | " | " | 370 mg/$m^2$ | " | " | " |
| Type of a solvent for the magenta coupler | TOP | " | " | " | " | " | " | " | " | " | " | " | " |
| Amount of the solvent coated | 600 mg/$m^2$ | " | " | " | " | " | " | " | " | 630 mg/$m^2$ | " | " | " |
| Type of an anti- | h | " | " | " | " | " | " | " | " | " | " | " | " |

TABLE III-continued

| | Sample No. | | | | | | | | | | | | |
|---|---|---|---|---|---|---|---|---|---|---|---|---|---|
| | Comparison | | | | | | Invention | | | | | | |
| | A-1 | B-1 | C-1 | D-1 | E-1 | F-1 | G-1 | H-1 | I-1 | J-1 | K-1 | L-1 | M-1 |
| fading agent | | | | | | | | | | | | | |
| Amount of the anti-fading agent coated | 270 mg/m$^2$ | " | " | " | " | " | " | " | " | 285 mg/m$^2$ | | | |
| 2nd layer (color mixing preventing layer) | | | | | | | | | | | | | |
| Amount of gelatin coated | 1500 mg/m$^2$ | " | " | " | " | " | " | " | " | " | " | " | " |
| 1st layer (blue-sensitive layer) | | | | | | | | | | | | | |
| Amount of Ag in a silver chlorobromide emulsion (Br 80%) | 400 mg/m$^2$ | " | " | " | " | " | " | " | " | " | " | " | " |
| Type of a yellow coupler | Y-36 | " | " | " | " | " | " | " | " | " | Y-35 | Y-10 | Y-35 |
| Amount of the yellow coupler coated | 600 mg/m$^2$ | " | " | " | " | " | " | " | " | " | 650 mg/m$^2$ | 600 mg/m$^2$ | 650 mg/m$^2$ |
| Type of a solvent for the yellow coupler | DBP | " | " | " | " | " | " | " | " | " | TOP | " | " |
| Amount of the solvent coated | 1000 mg/m$^2$ | " | " | " | " | " | " | " | " | " | " | " | " |
| Type of an anti-fading agent | i | " | " | " | " | " | " | " | " | " | " | " | " |
| Amount of the anti-fading agent coated | 100 mg/m$^2$ | " | " | " | " | " | " | " | " | " | " | " | " |

*The mark " in the above table means that it is the same as the left.

TABLE IV

| Sample No. | Remark | Fading under Sunlight, 2 Hours | | | Fading under Sunlight, 6 Hours | | | Fading under Sunlight, 4 Weeks | | | Fading under Sunlight, 8 Weeks | | |
|---|---|---|---|---|---|---|---|---|---|---|---|---|---|
| | | $D_B$ | $D_G$ | $D_R$ | $D_B$ | $D_G$ | $D_R$ | $D_B$ | $D_G$ | $D_R$ | $D_B$ | $D_G$ | $D_R$ |
| A-1 | Comparison | 1.00 | 1.00 | 0.92 | 1.00 | 1.00 | 0.88 | 0.93 | 0.93 | 0.85 | 0.83 | 0.84 | 0.72 |
| B-1 | " | 1.00 | 1.00 | 0.90 | 0.99 | 1.00 | 0.87 | 0.94 | 0.94 | 0.83 | 0.82 | 0.83 | 0.71 |
| C-1 | " | 1.00 | 1.00 | 0.92 | 1.00 | 1.00 | 0.89 | 0.93 | 0.93 | 0.84 | 0.83 | 0.84 | 0.70 |
| D-1 | " | 1.00 | 1.00 | 0.90 | 1.00 | 1.00 | 0.87 | 0.92 | 0.93 | 0.85 | 0.83 | 0.84 | 0.71 |
| E-1 | " | 1.00 | 1.00 | 0.91 | 0.99 | 0.99 | 0.88 | 0.94 | 0.94 | 0.82 | 0.82 | 0.83 | 0.70 |
| F-1 | " | 1.00 | 1.00 | 0.92 | 1.00 | 1.00 | 0.89 | 0.94 | 0.95 | 0.84 | 0.81 | 0.85 | 0.70 |
| G-1 | Invention | 1.00 | 1.00 | 0.99 | 1.00 | 1.00 | 0.97 | 0.94 | 0.95 | 0.92 | 0.82 | 0.84 | 0.83 |
| H-1 | " | 0.99 | 1.00 | 0.97 | 0.99 | 1.00 | 0.95 | 0.93 | 0.93 | 0.90 | 0.83 | 0.84 | 0.80 |
| I-1 | " | 1.00 | 1.00 | 0.98 | 1.00 | 1.00 | 0.97 | 0.94 | 0.93 | 0.91 | 0.82 | 0.84 | 0.84 |
| J-1 | " | 1.00 | 1.00 | 0.99 | 1.00 | 1.00 | 0.98 | 0.93 | 0.93 | 0.91 | 0.84 | 0.84 | 0.82 |
| K-1 | " | 0.99 | 1.00 | 0.99 | 0.99 | 0.99 | 0.98 | 0.93 | 0.94 | 0.91 | 0.83 | 0.83 | 0.81 |
| L-1 | " | 1.00 | 1.00 | 0.99 | 1.00 | 1.00 | 0.98 | 0.94 | 0.93 | 0.90 | 0.82 | 0.83 | 0.80 |
| M-1 | " | 1.00 | 1.00 | 0.98 | 1.00 | 1.00 | 0.98 | 0.96 | 0.96 | 0.91 | 0.83 | 0.88 | 0.81 |

($D_B$, $D_G$ and $D_R$ respectively represents the densities of yellow, magenta and cyan.)

EXAMPLE 3

Multilayer color photographic films (Sample Nos. 1 to 3) were prepared by coating the following first layer (lowermost layer) to the sixth layer (uppermost layer) shown in Table V on a cellulose triacetate support. In the following tabulation, mg/m$^2$ represents the amount of coating.

TABLE V

| | |
|---|---|
| 6th layer (protective layer) | Gelatin 750 mg/m$^2$ |
| 5th layer (green-sensitive layer) | Silver chlorobromide emulsion (silver bromide 30 mole %; silver 500 mg/m$^2$)<br>Gelatin 1,300 mg/m$^2$<br>Sensitizing dye (*1) 2.1 mg/m$^2$<br>Magenta coupler (*2) 600 mg/m$^2$<br>Solvent for the coupler (*3) 110 mg/m$^2$ |
| 4th layer | Gelatin 500 mg/m$^2$ |
| 3rd layer (red-sensitive layer) | Silver chlorobromide emulsion (silver bromide 30 mole %; silver 500 mg/m$^2$)<br>Gelatin 2,900 mg/m$^2$<br>Sensitizing dye (*4) 0.2 mg/m$^2$<br>Cyan coupler (*5) 1,500 mg/m$^2$<br>Ultraviolet light absorber (*6) 400 mg/m$^2$ |

TABLE V-continued

| | |
|---|---|
| | Solvent for the coupler (*7) 700 mg/m$^2$ |
| 2nd layer | Gelatin 500 mg/m$^2$ |
| 1st layer (blue-sensitive layer) | Silver iodobromide emulsion (silver iodide 0.2 mole %; silver 1,000 mg/m$^2$)<br>Gelatin 2,200 mg/m$^2$<br>Yellow coupler (*8) 1,200 mg/m$^2$<br>Solvent for the coupler (*9) 600 mg/m$^2$ |
| Support | Cellulose triacetate |

(*1): Sensitizing dye, triethylammonium 4-[6-chloro-5-cyano-1-ethyl-2-{3-[5-phenyl-3-(4-sulfonaphthobutyl)benzoxazolin-2-ylidene]-1-propenyl}benzimidazolium-3]butane sulfonate
(*2): Magenta coupler, M-18 given hereinabove
(*3): Solvent for the coupler, tricresyl phosphate
(*4): Sensitizing dye, potassium 2-{5-[4-(6-methyl-3-pentylbenzothiazolin-2-ylidene)-2-methyl-2-butenylidene]-3-rhodanine} acetate
(*5): Cyan coupler, used in accordance with the Film Sample Nos. 1 to 3 in Table VI.
(*6): Ultraviolet light absorber, UV-2/UV-3/UV-4 mixture (3:3:4 by weight)
(*7): Solvent for the coupler, used in accordance with Film Sample Nos. 1 to 3 in Table VI.
(*8): Yellow coupler, Compound Y-1 given hereinabove
(*9): Solvent for the coupler, dibutyl phthalate By using the couplers and solvents shown in Table VI, the Sample Nos. 1 to 3 were prepared.

Each of the sample films was exposed to blue light, green light and red light through a continuous wedge, and developed in the following manner.

The processed samples were tested for optical density to red light, and the gamma values and maximum densities shown in Table VII were obtained.

To evaluate the hues of the processed films, the spectral density of the cyan dye image was measured by using a self-recording spectrophotometer (Model 340 made by Hitachi Ltd.). The maximum density wavelength ($\lambda_{max}$) and the half value width ($\lambda\frac{1}{2}$) of absorption on shorter wavelengths were determined, and are shown in Table VII.

The processed films were also tested for the fastness of the cyan dye image. The fastness of each sample upon standing in the dark at 100° C. for 3 days, the fastness of the sample upon standing in the dark at 60° C. and 70% RH (relative humidity) for 6 weeks, and the fastness of the sample upon exposure to light for 7 days by a xenon tester (20,000 lux) were expressed by the percent decrease of the density from the initial density of 1.0. The results are shown in Table VII. The decrease of cyan is based on the density at the time when the vanished color returned to its original color.

| Development Steps | |
|---|---|
| Color development | 36° C., 3 minutes |
| Stopping | 36° C., 40 seconds |
| First fixing | 36° C., 40 seconds |
| Bleaching | 36° C., 1 minute |
| Second fixing | 36° C., 40 seconds |
| Washing with water | 30° C., 30 seconds |
| **Composition of the Color Developer** | |
| Sodium sulfite | 5 g |
| 4-Amino-3-methyl-N,N—diethylaniline | 3 g |
| Sodium carbonate | 20 g |
| Potassium bromide | 2 g |
| Water to make | 1 liter |
| | pH 10.5 |
| **Composition of the Stopping Solution** | |
| Sulfuric acid (6 N) | 50 ml |
| Water to make | 1 liter |
| | pH 1.0 |
| **Composition of the Fixing Solution** | |
| Ammonium thiosulfate | 60 g |
| Sodium sulfite | 2 g |
| Sodium hydrogensulfite | 10 g |
| Water to make | 1 liter |
| | pH 5.8 |
| **Composition of the Bleaching Solution** | |
| Potassium ferricyanide | 30 g |
| Potassium bromide | 15 g |
| Water to make | 1 liter |
| | pH 6.5 |

The results given in Table VII demonstrate that the use of the couplers in accordance with this invention gave better color formability (higher gamma and higher maximum density) and better dye image fastness than the use of known couplers for comparison, and also permits adjustment of hue while narrowing the half value width of absorptions.

TABLE VI

| Film Sample | Coupler and its Amount ($\times 10^{-1}$ mole/mole of Ag) | | Solvent for the Coupler |
|---|---|---|---|
| 1 (comparison) | a | 4.0 | *S-1 (60%) + *S-2 (40%) |
| 2 | a/c-1 | 2.0/2.0 | *S-1 (60%) + *S-2 (40%) |
| 3 | c-1 | 4.0 | *S-1 (60%) + *S-2 (40%) |

*S-1: Dibutyl phthalate
*S-2: 2,4-Di-tert-amylphenol

TABLE VII

| Film Sample | Hue of the Dye Formed* | | Color Formability | | Fastness of the Dye Image (percent decrease, %) | | |
|---|---|---|---|---|---|---|---|
| | $\gamma_{max}$ (nm) | $\gamma\frac{1}{2}$ (nm) | Gamma | Maximum Density | 100° C., 3 Days | 60° C., 70% RH 6 Weeks | Light (xenon) 7 Days |
| 1 (comparison) | 670 | 70 | 3.58 | 3.45 | 52 | 23 | 14 |
| 2 (invention) | 666 | 70 | 3.64 | 3.53 | 14 | 6 | 11 |
| 3 (invention) | 660 | 68 | 3.76 | 3.55 | 8 | 4 | 10 |

*$\gamma\frac{1}{2}$ was measured and is defined as the difference between the wavelength at which the absorption intensity is 50% of the maximum absorption intensity of the spectrum, and the wavelength at which the density is maximum.

EXAMPLE 4

Multilayer color photographic films (Sample Nos. 4 to 6) were prepared by coating the following first layer (lowermost layer) to the sixth layer (uppermost layer) shown in Table VIII on a cellulose triacetate support. In the following tabulation, mg/m$^2$ represents the amount of coating.

TABLE VIIII

| | |
|---|---|
| 6th layer (protective layer) | Gelatin 750 mg/m$^2$ |
| 5th layer (green-sensitive layer) | Silver chlorobromide emulsion (silver bromide 30 mole %; silver 500 mg/m$^2$)<br>Gelatin 1,300 mg/m$^2$<br>Sensitizing dye (*1) 2.1 mg/m$^2$<br>Magenta coupler (*2) 700 mg/m$^2$<br>Fading preventing agent (*3) 540 mg/m$^2$<br>Solvent for the coupler (*4) 1,050 mg/m$^2$ |
| 4th layer | Gelatin 500 mg/m$^2$ |
| 3rd layer (red-sensitive layer) | Silver chlorobromide emulsion (silver bromide 30 mole %; silver 500 mg/m$^2$)<br>Gelatin 2,900 mg/m$^2$<br>Sensitizing dye (*5) 0.2 mg/m$^2$<br>Cyan coupler (*6) 1,500 mg/m$^2$<br>Ultraviolet light absorber (*7) 400 mg/m$^2$<br>Solvent for the coupler (*8) 700 mg/m$^2$ |
| 2nd layer | Gelatin 500 mg/m$^2$ |
| 1st layer (blue-sensitive layer) | Silver iodobromide emulsion (silver iodide 0.2 mole %; silver 1,000 mg/m$^2$)<br>Gelatin 2,200 mg/m$^2$<br>Yellow coupler (*9) 1,200 mg/m$^2$<br>Solvent for the coupler (*10) 600 mg/m$^2$ |

TABLE VIIII-continued

| Support | Cellulose triacetate |
|---|---|

(*1): Sensitizing dye, triethylammonium 4-[6-chloro-5-cyano-1-ethyl-2-{3-[5-phenyl-3-(4-sulfonaphthobutyl)benzoxazolin-2-ylidene]-1-propenyl}-benzimidazolium-3]butane sulfonate
(*2): Magenta coupler, M-40 given hereinabove
(*3): G-14
(*4): Solvent for the coupler, tricresyl phosphate
(*5): Sensitizing dye, potassium 2-{5-[4-(6-methyl-3-pentylbenzothiazolin-2-ylidene)-2-methyl-2-butenylidene]-3-rhodanine} acetate
(*6): Cyan coupler, used in accordance with the Film Sample Nos. 4 to 6 in Table IX.
(*7): Ultraviolet light absorber, UV-2/UV-3/UV-4 mixture (3:3:4 by weight)
(*8): Solvent for the coupler, used in accordance with Film Sample Nos. 4 to 6 in Table IX.
(*9): Yellow coupler, Compound Y-1 given hereinabove
(*10): Solvent for the coupler, dibutyl phthalate

TABLE IX

| Film Sample | Coupler and its Amount ($\times 10^{-1}$ mole/mole of Ag) | | Solvent for the Coupler |
|---|---|---|---|
| 4 (comparison) | a | 4.0 | *S-1 (60%) + *S-2 (40%) |
| 5 | a/c-1 | 2.0/2.0 | *S-1 (60%) + *S-2 (40%) |
| 6 | c-1 | 4.0 | *S-1 (60%) + *S-2 (40%) |

*S-1: Dibutyl phthalate
*S-2: 2,4-Di-tert-amylphenol

TABLE X

| Film Sample | Hue of the Dye Formed* | | Color Formability | | Fastness of the Dye Image (percent decrease, %) | | |
|---|---|---|---|---|---|---|---|
| | $\gamma_{max}$ (nm) | $\gamma_{\frac{1}{2}}$ (nm) | Gamma | Maximum Density | 100° C., 3 Days | 60° C., 70% RH 6 Weeks | Light (xenon) 7 Days |
| 4 (comparison) | 670 | 70 | 3.55 | 3.45 | 52 | 23 | 13 |
| 5 (invention) | 666 | 70 | 3.62 | 3.54 | 14 | 7 | 9 |
| 6 (invention) | 660 | 68 | 3.75 | 3.56 | 8 | 5 | 8 |

*$\gamma_{\frac{1}{2}}$ was measured and is defined as the difference between the wavelength at which the absorption intensity is 50% of the maximum absorption intensity of the spectrum, and the wavelength at which the density is maximum.

By using the couplers and solvents shown in Table IX, the Sample Nos. 4 to 6 were prepared.

Each of the sample films was exposed to blue light, green light and red light through a continuous wedge, and developed in the same manner as in Example 3.

The processed samples were tested for optical density to red light, and the gamma values and maximum densities shown in Table X were obtained.

To evaluate the hues of the processed films, the spectral density of the cyan dye image was measured by using a self-recording spectrophotometer (Model 340 made by Hitachi Ltd.). The maximum density wavelength ($\lambda_{max}$) and the half value width ($\lambda_{\frac{1}{2}}$) of absorption on shorter wavelengths were determined, and are shown in Table X.

The processed films were also tested for the fastness of the cyan dye image. The fastness of each sample upon standing in the dark at 100° C. for 3 days, the fastness of the sample upon standing in the dark at 60° C. and 70% RH for 6 weeks, and the fastness of the sample upon exposure to light for 7 days by a xenon tester (20,000 lux) were expressed by the percent decrease of the density from the initial density of 1.0. The results are shown in Table X. The decrease of cyan is based on the density at the time when the vanished color returned to its original color.

The results given in Table X demonstrate that the use of the couplers in accordance with this invention gave better color formability (higher gamma and higher maximum density) and better dye image fastness than the use of known couplers for comparison, and also permits adjustment of hue while narrowing the half value width of absorptions. Further, they also demonstrate that the use of the pyrazolazole coupler in the green-sensitive layer increases the saturation of the magneta color gives an excellent color image.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support and red-sensitive, green-sensitive and blue-sensitive light-sensitive layers formed on the support, said light-sensitive layers separately containing a coupler represented by the following formula (I), a coupler represented by the following formula (II) or (III), and a coupler represented by the following formula (IV):

(I)

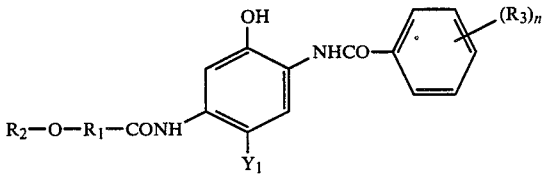

(II)

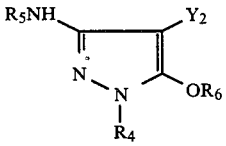

(III)

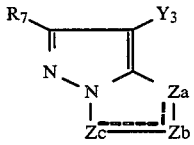

(IV)

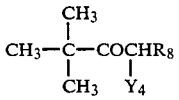

wherein $R_1$ represents a substituted or unsubstituted divalent aliphatic group, $R_2$ represents a phenyl group substituted by at least one cyano group, or a phenyl group substituted by at least one chlorine atom at the ortho-position, $R_3$ represents a hydrogen atom, a halogen atom, or a substituted or unsubstituted alkyl or alkoxy group, n represents an integer of 1 to 5, and when n is 2 or more, the $R_3$ substituents may be identical or different, $R_4$ and $R_5$ each represents a substituted or unsubstituted phenyl group, $R_6$ represents a hydrogen atom, an acyl group or an aliphatic or aromatic sulfonyl group, $R_7$ represents a hydrogen atom or a substituent, $R_8$ represents a substituted or unsubstituted N-phenylcarbamoyl group, $Z_a$, $Z_b$ and $Z_c$ each represents methine, substituted methine, =N— or —NH—, $Y_1$, $Y_2$, $Y_3$ nad $Y_4$ each represents a hydrogen atom or a group which can be split off during the coupling reaction with the oxidation product of a developing agent, a dimer or a polymer may be formed by $R_2$, $R_3$ or $Y_1$; $R_4$, $R_5$ or $Y_2$; $R_7$, $Y_3$ or $Z_a$, $Z_b$ or $Z_c$ which is substituted methine; or $R_8$ or $Y_4$, and the aliphatic group above is linear, branched or cyclic, and saturated or unsaturated.

2. A silver halide color photographic light-sensitive material as claimed in claim 1, wherein the blue-sensitive silver halide layer contains at least one coupler represented by the formula (IV), the green-sensitive silver halide layer contains at least one coupler represented by the formula (II) or (III), and the red-sensitive silver halide layer contains at least one coupler represented by the formula (I).

3. A silver halide color photographic light-sensitive material as claimed in claim 1, wherein $R_1$ is a branched alkylene group, $R_2$ is a phenyl group substituted by at least one chlorine atom at the ortho-position, and $R_3$ is a halogen atom or an alkyl group.

4. A silver halide color photographic light-sensitive material as claimed in claim 2, wherein $R_1$ is a branched alkylene group, $R_2$ is a phenyl group substituted by at least one chlorine atom at the ortho-position, and $R_3$ is a halogen atom or an alkyl group.

5. A silver halide color photographic light-sensitive material as claimed in claim 2, wherein the green-sensitive silver halide layer contains at least one coupler represented by formulae (V) to (IX):

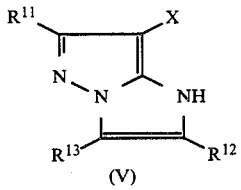

(V)

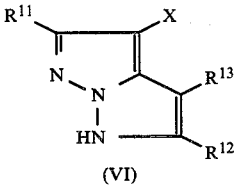

(VI)

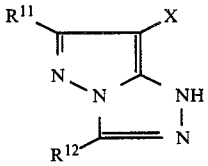

(VII)

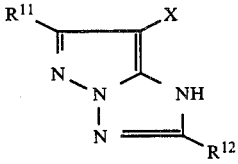

(VIII)

-continued

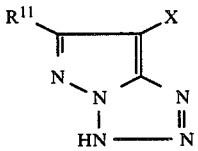

(IX)

wherein $R^{11}$, $R^{12}$ and $R^{13}$ each represents a substituted or unsubstituted aliphatic, aromatic or heterocyclic group,

RO, RC(=O)—, RCO(=O)—, RSO—, $RSO_2$—, $RSO_2NH$—,

RCNH(=O)—, RNH—, RS—, ROCNH(=O)—, a hydrogen atom, a halogen atom, a cyano group, an imido group, or a substituted or unsubstituted carbamoyl, sulfamoyl, ureido or sulfamoylamino group, wherein R represents a substituted or unsubstituted aliphatic, aromatic or heterocyclic group, X represents a hydrogen atom or a group which can be split off during the coupling reaction with the oxidation product of a developing agent, and either one of $R^{11}$, $R^{12}$, $R^{13}$ and X can be a divalent group and form a dimer, or can be a divalent group linking the main chain of the polymer with the chromophore of the coupler.

6. A silver halide color photographic light-sensitive material as claimed in claim 2, wherein the green-sensitive silver halide layer contains at least one coupler represented by formulae (V), (VII) and (VIII):

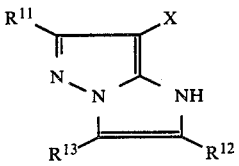

(V)

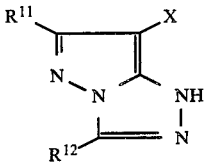

(VII)

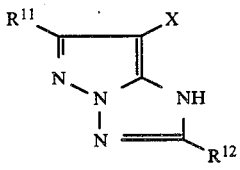

(VIII)

wherein $R^{11}$, $R^{12}$ and $R^{13}$ each represents a substituted or unsubstituted aliphatic, aromatic or heterocyclic group,

RO, RC(=O)—, RCO(=O)—, RSO—, $RSO_2$—, $RSO_2NH$—,

-continued $$\overset{\overset{\displaystyle O}{\|}}{RC}NH-,\ RNH-,\ RS-,\ RO\overset{\overset{\displaystyle O}{\|}}{C}NH-,$$

a hydrogen atom, a halogen atom, a cyano group, an imido group, or a substituted or unbustituted carbamoyl, sulfamoyl, ureido or sulfamoylamino group, wherein R represents a substituted or unsubstituted aliphatic, aromatic or heterocyclic group, X represents a hydrogen atom or a group which can be split off during the coupling reaction with the oxidation product of a developing agent, and either one of $R^{11}$, $R^{12}$, $R^{13}$ and X can be a divalent group and form a dimer, or can be a divalent group linking the main chain of the polymer with the chromophore of the coupler.

7. A silver halide color photographic light-sensitive material as claimed in claim 2, wherein the green-sensitive silver halide layer contains at least one coupler represented by formula (VIII):

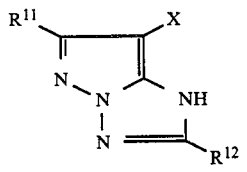

(VIII)

wherein $R^{11}$, $R^{12}$ and $R^{13}$ each represents a substituted or unsubstituted aliphatic, aromatic or heterocyclic group, $$RO,\ R\overset{\overset{\displaystyle O}{\|}}{C}-,\ R\overset{\overset{\displaystyle O}{\|}}{C}O-,\ RSO-,\ RSO_2-,\ RSO_2NH-,$$

$$R\overset{\overset{\displaystyle O}{\|}}{C}NH-,\ RNH-,\ RS-,\ RO\overset{\overset{\displaystyle O}{\|}}{C}NH-,$$

a hydrogen atom, a halogen atom, a cyano group, an imido group, or a substituted or unsubstituted carbamoyl, sulfamoyl, ureido or sulfamoylamino group, wherein R represents a substituted or unsubstituted aliphatic, aromatic or heterocyclic group, X represents a hydrogen atom or a group which can be split off during the coupling reaction with the oxidation product of a developing agent, and either one of $R^{11}$, $R^{12}$, $R^{13}$ and X can be a divalent group and form a dimer, or can be a divalent group linking the main chain of the polymer with the chromophore of the coupler.

8. A silver halide color photographic light-sensitive material as claimed in claim 4, wherein the green-sensitive silver halide layer contains at least one coupler represented by formula (VIII):

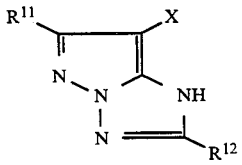

(VIII)

wherein $R^{11}$, $R^{12}$ and $R^{13}$ each represents a substituted or unsubstituted aliphatic, aromatic or heterocyclic group, $$RO,\ R\overset{\overset{\displaystyle O}{\|}}{C}-,\ R\overset{\overset{\displaystyle O}{\|}}{C}O-,\ RSO-,\ RSO_2-,\ RSO_2NH-,$$

$$R\overset{\overset{\displaystyle O}{\|}}{C}NH-,\ RNH-,\ RS-,\ RO\overset{\overset{\displaystyle O}{\|}}{C}NH-,$$

a hydrogen atom, a halogen atom, a cyano group, an imido group, or a substituted or unsubstituted carbamoyl, sulfamoyl, uriedo or sulfamoylamino group, wherein R represents a substituted or unsubstituted aliphatic, aromatic or heterocyclic group, X represents a hydrogen atom or a group which can be split off during the coupling reaction with the oxidation product of a developing agent, and either one of $R^{11}$, $R^{12}$, $R^{13}$ and X can be a divalent group and form a dimer, or can be a divalent group linking the main chain of the polymer with the chromophore of the coupler.

9. A silver halide color photographic light-sensitive material as claimed in claim 2, wherein at least one ultraviolet light absorber represented by formula (XVII):

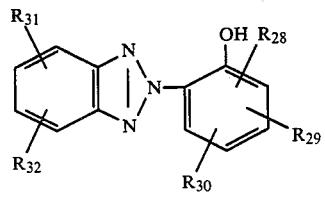

(XVII)

wherein $R_{28}$, $R_{29}$, $R_{30}$, $R_{31}$ and $R_{32}$, which may be the same or different, each represents a hydrogen atom or a substituted or unsubstituted aromatic group, and $R_{31}$ and $R_{32}$ can be cyclized to form a 5- or 6-membered aromatic ring composed of carbon atoms, is included in both layers adjacent to the red-sensitive emulsion layer containing the cyan coupler.

10. A silver halide color photographic light-sensitive material as claimed in claim 1, wherein $R_8$ is represented by formula (IV-A):

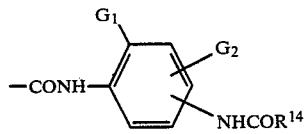

(IV-A)

wherein $G_1$ represents a halogen atom or an alkoxy group, $G_2$ represents a hydrogen atom, a halogen atom or a substituted or unsubstituted alkoxy group, and $R^{14}$ represents a substituted or unsubstituted alkyl group.

11. A silver halide color photographic light-sensitive material as claimed in claim 2, wherein $R_8$ is represented by formula (IV-A):

(IV-A)

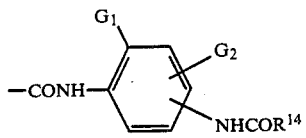

wherein $G_1$ represents a halogen atom or an alkoxy group, $G_2$ represents a hydrogen atom, a halogen atom or a substituted or unsubstituted alkoxy group, and $R^{14}$ represents a substituted or unsubstituted alkyl group.

12. A silver halide color photographic light-sensitive material as claimed in claim 1, wherein $R_6$ is a hydrogen atom and $Y_2$ is a split-off group which is connected through sulfur.

13. A silver halide color photographic light-sensitive material as claimed in claim 2, wherein $R_6$ is a hydrogen atom and $Y_2$ is a split-off group which is connected through sulfur.

14. A silver halide color photographic light-sensitive material as claimed in claim 1, wherein $Y_4$ is a group represented by either one of formulae (XIV) to (XVI):

(XIV)

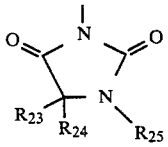

(XV)

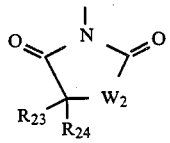

(XVI)

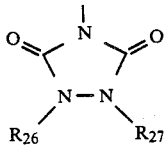

wherein each of $R_{23}$ and $R_{24}$ represents a hydrogen atom, an alkyl group, an aryl group, an alkoxy group, an aryloxy group or a hydroxyl group, each of $R_{25}$, $R_{26}$ and $R_{27}$ represents a hydrogen atom, an alkyl group, an aryl group, an aralkyl group or an acyl group, and $W_2$ represents an oxygen or sulfur atom.

15. A silver halide color photographic light-sensitive material as claimed in claim 2, wherein $Y_4$ is a group represented by either one of formulae (XIV) to (XVI):

(XIV)

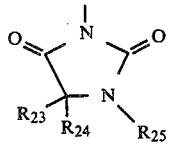

(XV)

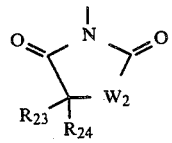

(XVI)

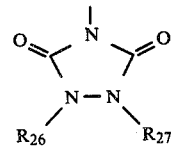

wherein each of $R_{23}$ and $R_{24}$ represents a hydrogen atom, an alkyl group, an aryl group, an alkoxy group, an aryloxy group or a hydroxyl group, each of $R_{25}$, $R_{26}$ and $R_{27}$ represents a hydrogen atom, an alkyl group, an aryl group, an aralkyl group or an acyl group, and $W_2$ represents an oxygen or sulfur atom.

16. A silver halide color photographic light-sensitive material as claimed in claim 4, wherein 4,6-dichloro-5-ethyl-2-(2,4-di-tert-amylphenoxypropylidenecarbonylamino)phenol is used together with the coupler represented by the formula (I).

17. A silver halide color photographic light-sensitive material as claimed in claim 1, wherein said photographic light-sensitive material contains a coupler represented by the formula (III).

18. A silver halide color photographic light-sensitive material is claimed in claim 2, wherein the green-sensitive silver halide layer contains at least one coupler represented by the formula (III).

19. A silver halide color photographic light-sensitive material as claimed in claim 1, wherein said photographic light-sensitive material contains a coupler represented by the formula (II).

20. A silver halide color photographic light-sensitive material as claimed in claim 2, wherein the green-sensitive silver halide layer contains at least one coupler represented by the formula (II).

* * * * *